US008909073B2

(12) United States Patent
Hosoya et al.

(10) Patent No.: US 8,909,073 B2
(45) Date of Patent: Dec. 9, 2014

(54) DEVELOPING UNIT, PROCESS CARTRIDGE, AND IMAGE FORMING APPARATUS

(75) Inventors: Shinji Hosoya, Naka-gun (JP); Toshikazu Tsuchiya, Susono (JP); Hidetoshi Hanamoto, Mishima (JP); Tsutomu Ishida, Suntou-gun (JP); Taku Fukita, Mishima (JP); Hidehiro Ushiozu, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 216 days.

(21) Appl. No.: 13/557,071

(22) Filed: Jul. 24, 2012

(65) Prior Publication Data

US 2013/0039670 A1 Feb. 14, 2013

(30) Foreign Application Priority Data

Aug. 10, 2011 (JP) ..... 2011-175004

(51) Int. Cl.
*G03G 15/08* (2006.01)

(52) U.S. Cl.
CPC ..... *G03G 15/0889* (2013.01)
USPC ..... 399/27; 399/63

(58) Field of Classification Search
CPC ..... G03G 15/0889; G03G 15/0853; G03G 15/086; G03G 15/0829
USPC ..... 399/63, 27, 61, 30
See application file for complete search history.

(56) References Cited

U.S. PATENT DOCUMENTS

| | | | | |
|---|---|---|---|---|
| 5,755,358 | A * | 5/1998 | Fisk | |
| 7,460,798 | B2 * | 12/2008 | Toda et al. | 399/27 |
| 7,761,015 | B2 * | 7/2010 | Wong | 399/27 |
| 2012/0148271 | A1 * | 6/2012 | Fukita et al. | 399/27 |

FOREIGN PATENT DOCUMENTS

| | | | |
|---|---|---|---|
| JP | 1-6986 | A | 1/1989 |
| JP | 4-35159 | U | 3/1992 |

* cited by examiner

*Primary Examiner* — Susan Lee
(74) *Attorney, Agent, or Firm* — Canon USA, Inc., IP Division

(57) ABSTRACT

A developing unit includes a developer storage unit, a developer bearing member, an agitation member, a flexible member, and a magnet member. The developer storage unit stores a developer. The developer bearing member develops an electrostatic latent image formed on an image bearing member with the developer. The agitation member agitates the developer in the developer storage unit. The flexible member, disposed in the developer storage unit, is distorted by pressure applied by the agitation member via the developer. The magnet member, disposed on the flexible member, is displaced in response to the flexible member being distorted.

16 Claims, 28 Drawing Sheets

FIG. 6C

TABLE T

| DURATION[msec] | REMAINING TONER AMOUNT[%] |
|---|---|
| 109.7 | 100 |
| 108.5 | 95 |
| 107.3 | 90 |
| 106.1 | 85 |
| 104.9 | 80 |
| 103.7 | 75 |
| 102.5 | 70 |
| 101.3 | 65 |
| 100.1 | 60 |
| 98.9 | 55 |
| 97.7 | 50 |
| 96.5 | 45 |
| 95.3 | 40 |
| 94.3 | 35 |
| 93.0 | 30 |
| 92.0 | 25 |
| 90.8 | 20 |
| 90.5 | 15 |
| 89.0 | 10 |
| 86.9 | 5 |
| 85.7 | 0 |

FIG. 12C

| TABLE K | |
|---|---|
| TIME DIFFERENCE [msec] | REMAINING TONER AMOUNT [%] |
| 659 | 100 |
| 658.3 | 95 |
| 657.8 | 90 |
| 657.2 | 85 |
| 656.5 | 80 |
| 655.8 | 75 |
| 654.6 | 70 |
| 653.5 | 65 |
| 652.2 | 60 |
| 650.8 | 55 |
| 649 | 50 |
| 647.2 | 45 |
| 645.5 | 40 |
| 643.8 | 35 |
| 641.6 | 30 |
| 639.5 | 25 |
| 637.5 | 20 |
| 636.5 | 15 |
| 636 | 10 |
| 635.5 | 5 |
| 635 | 0 |

DEVELOPING UNIT, PROCESS CARTRIDGE, AND IMAGE FORMING APPARATUS

BACKGROUND OF THE INVENTION

1. Field of the Invention

The present invention relates to detection of a remaining amount of developer in an image forming apparatus such as a laser printer, a copying machine, and a facsimile machine employing an electrophotographic method.

2. Description of the Related Art

In related-art image forming apparatuses, there are cases where a remaining amount of toner inside a toner container is detected using a piezoelectric sensor or an ultrasonic sensor.

For example, Japanese Patent Application Laid-Open No. 1-6986 discusses a remaining toner amount detection apparatus including a piezoelectric sensor. The piezoelectric sensor is disposed on the bottom of a hopper such that a detection unit is faced upward in a position where an agitator rotation thin plate member passes in proximity to the piezoelectric sensor. Such a detection apparatus detects a remaining toner amount based on the ratio of the time needed for an agitator to rotate one rotation to the time needed for pressure of the sensor to be detected. In this detection apparatus, an output of the piezoelectric sensor is fixed to the logic in the presence of toner where a remaining toner amount keeps a certain level of amount or more. On the other hand, an output of the piezoelectric sensor is fixed to the logic in the absence of toner where a toner amount decreases to a certain level of amount or less, and the amount is not detected.

The remaining toner amount detection unit disclosed in Japanese Patent Application Laid-Open No. 1-6986 can only detect the presence or absence of toner. Thus, the detection unit cannot sequentially detect changes in a remaining toner amount. Moreover, with the operation speed of image forming apparatuses accelerated recently, an agitation member operates at high speed. Thus, toner is stirred up and remains in a detection position of a piezoelectric sensor until the toner is completely used up. This causes a difficulty in providing a time period for which a remaining toner weight is not detected.

SUMMARY OF THE INVENTION

The present invention is directed to a developing unit that is capable of sequentially detecting a remaining toner amount with a configuration from a large toner amount state to a small toner amount state. The developing unit can detect the toner remaining amount with good accuracy even when an agitation member is in operation at high speed.

According to an aspect of the present invention, a developing unit includes a developer storage unit configured to store a developer, a developer bearing member configured to develop an electrostatic latent image formed on an image bearing member with the developer, an agitation member configured to agitate the developer in the developer storage unit, a flexible member, disposed in the developer storage unit, configured to be distorted by pressure applied by the agitation member via the developer, and a magnet member, disposed on the flexible member, configured to be displaced in response to the flexible member being distorted.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIGS. 6A, 6B, and 6C are a graph, a waveform, and Table T, respectively, illustrating a characteristic of remaining toner amount detection according to the first exemplary embodiment.

FIGS. 12A, 12B, and 12C are a graph, a waveform, and Table K illustrating a characteristic of remaining toner amount detection according to the third exemplary embodiment.

DESCRIPTION OF THE EMBODIMENTS

Various exemplary embodiments, features, and aspects of the invention will be described in detail below with reference to the drawings.

Figure 1:
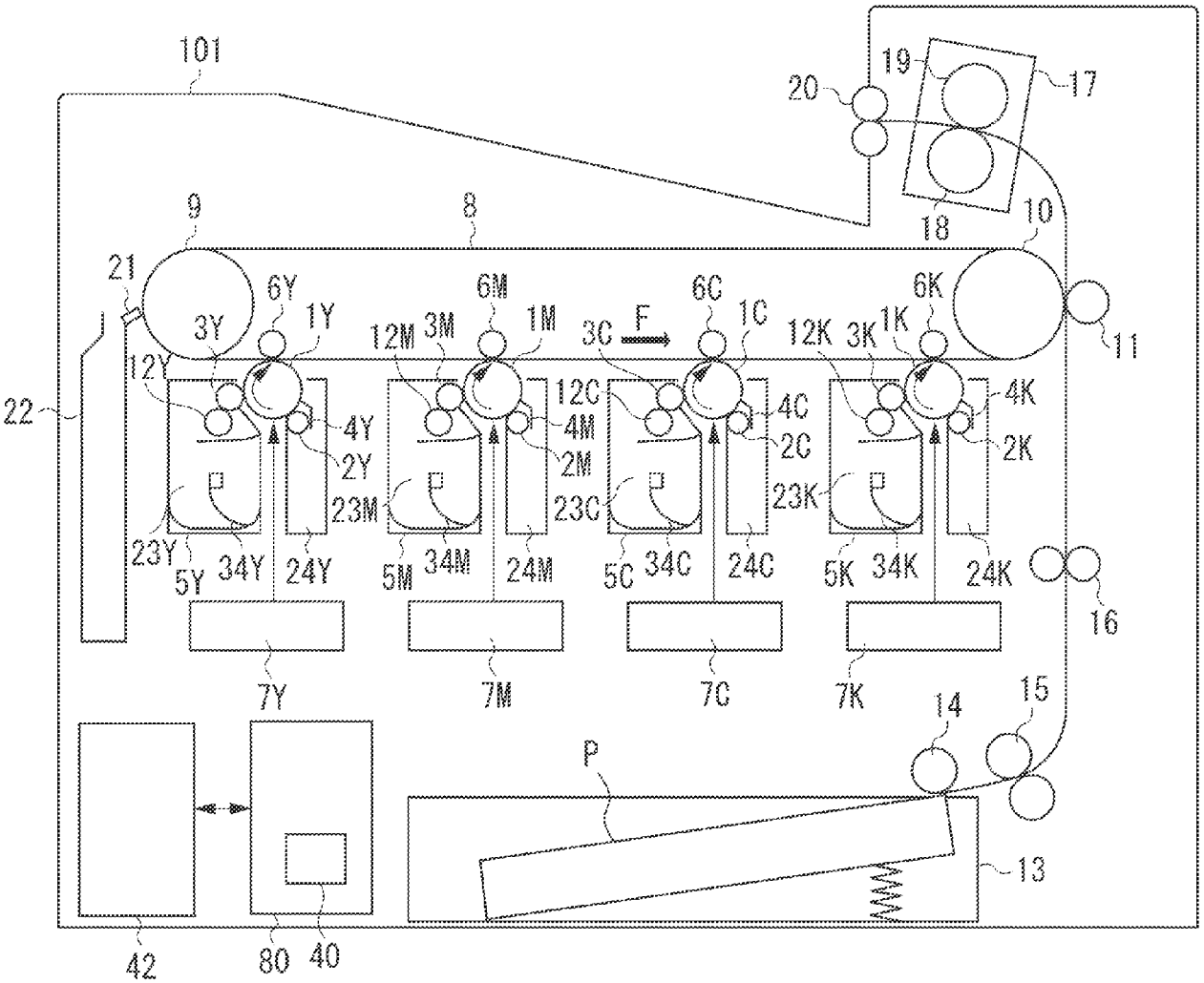
FIG. 1 is a sectional view illustrating a configuration of a color laser printer according to an exemplary embodiment.

FIG. 1 is a diagram illustrating a configuration of a laser printer according to a first exemplary embodiment. A laser printer (hereinafter referred to as a main body) 101 includes process cartridges 5Y, 5M, 5C, and 5K. Each of these four process cartridges is detachable from the main body 101, and has a similar configuration except for color. More particularly, the process cartridges 5Y, 5M, 5C, and 5K differ from one another in image formation with toners of yellow (Y), magenta (M), cyan (C), and black (K), respectively. The process cartridges 5Y, 5M, 5C, and 5K broadly include a developing unit, an image forming unit, and a waste toner unit. The developing unit includes developing rollers 3Y, 3M, 3C, and 3K, toner replenishing rollers 12Y, 12M, 12C, and 12K, toner containers (developer containing units) 23Y, 23M, 23C, and 23K, and agitation sheets (agitation member) 34Y, 34M, 34C, and 34K. The image forming unit includes photosensitive drums 1Y, 1M, 1C, and 1K serving as image bearing members, and charging rollers 2Y, 2M, 2C, and 2K. The waste toner unit includes drum cleaning blades 4Y, 4M, 4C, and 4K, and waste toner containers 24Y, 24M, 24C, and 24K.

Laser units 7Y, 7M, 7C, and 7K are disposed below the process cartridges 5Y, 5M, 5C, and 5K, respectively. The laser units 7Y, 7M, 7C, and 7K irradiate the photosensitive drums 1Y, 1M, 1C, and 1K, respectively, with laser light based on image signals. The photosensitive drums 1Y, 1M, 1C, and 1K are charged to predetermined negative-polarity potential by the charging rollers 2Y, 2M, 2C, and 2K, and then form electrostatic latent images thereon by the laser units 7Y, 7M, 7C, and 7K, respectively. The developing rollers 3Y, 3M, 3C, and 3K reversely develop the electrostatic latent images with respective toners having negative polarity, thereby forming toner images of Y, M, C, and Y, respectively.

An intermediate transfer belt unit includes an intermediate transfer belt 8, a drive roller 9, and a secondary transfer counter roller 10. Primary transfer rollers 6Y, 6M, 6C, and 6K are disposed on an inner side of the intermediate transfer belt 8, facing the photosensitive drums 1Y, 1M, 1C, and 1K, respectively. A bias applying unit (not illustrated) applies a transfer bias to the primary transfer rollers 6Y, 6M, 6C, and 6K.

The toner images formed on the photosensitive drums 1Y, 1M, 1C, and 1K are rotated in directions indicated by respective arrows of the photosensitive drums 1Y, 1M, 1C, and 1K illustrated in FIG. 1, and the intermediate transfer belt 8 is rotated in a direction indicated by an arrow F illustrated in FIG. 1. A positive-polarity bias is applied to the primary transfer rollers 6Y, 6M, 6C, and 6K, so that the toner images formed on the respective photosensitive drums are primarily transferred to the intermediate transfer belt 8 in order from the photosensitive drum 1Y. Accordingly, toner images of the four colors, overlapping with one another, are conveyed to a secondary transfer roller 11.

A sheet feed and conveyance device includes a sheet feeding roller 14 and a conveyance roller pair 15. The sheet feeding roller 14 feeds a transfer material P from a sheet cassette 13 storing the transfer material P, whereas the conveyance roller pair 15 conveys the fed transfer material P. The transfer material P conveyed from the sheet feed and conveyance device is conveyed to the secondary transfer roller 11 by a registration roller pair 16.

When the toner images are transferred from the intermediate transfer belt 8 to the transfer material P, a positive-polarity bias is applied to the secondary transfer roller 11, so that the four-color toner images on the intermediate transfer belt 8 are secondarily transferred to the conveyed transfer material P. Subsequently, the transfer material P is conveyed to a fixing device 17 in which a fixing film 18 and a pressing roller 19 apply heat and pressure to the transfer material P, so that the toner images are fixed onto a surface of the transfer material P. The fixed transfer material P is discharged by a discharge roller pair 20.

After the toner images are transferred to the transfer material P, toners remained on surfaces of the photosensitive drums 1Y, 1M, 1C, and 1K are removed by the drum cleaning blades 4Y, 4M, 4C, and 4K, respectively. Then, the respective removed toners are collected by waste toner collection containers 24Y, 24M, 24C, and 24K. Moreover, toners remained on the intermediate transfer belt 8 after the secondary transfer of the toner images to the transfer material P are removed by a transfer belt cleaning blade 21. The removed toners are collected by a waste toner collection container 22.

A control circuit board 80 illustrated in FIG. 1 controls the main body 101, with an electric circuit mounted thereon. The control circuit board 80 has a one-chip microcomputer (hereinafter referred to as a central processing unit (CPU)) 40 mounted thereon. The CPU 40 (control unit) collectively controls operation of the main body 101. For example, the CPU 40 controls a drive source (not illustrated) for conveyance of the transfer material P, a drive source (not illustrated) for process cartridges, image formation, and failure detection.

A video controller 42 controls emission of laser in the laser units 7Y, 7M, 7C, and 7K based on image data. Moreover, the video controller 42 interfaces with a user via a control panel (not illustrated). This control panel displays thereon remaining toner amounts (developer amounts) of the respective colors in a bar chart.

The present exemplary embodiment has been described using reference symbols Y, M, C, and K indicating colors. However, such reference symbols Y, M, C, and K are omitted in the description below.

Figure 2A:
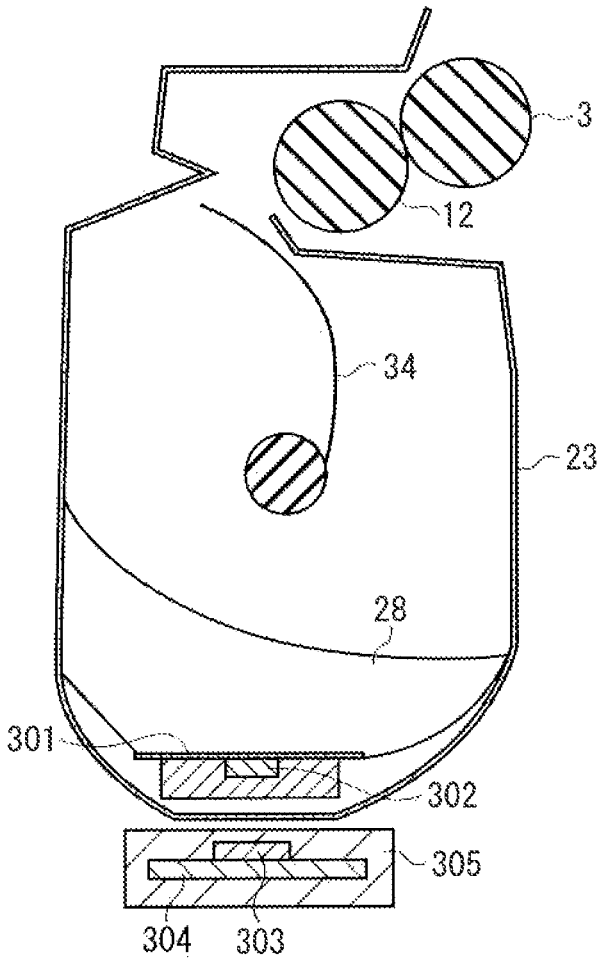
FIGS. 2A and 2B are a sectional view and an enlarged view, respectively, illustrating a developing unit according to a first exemplary embodiment.
Figure 2B:
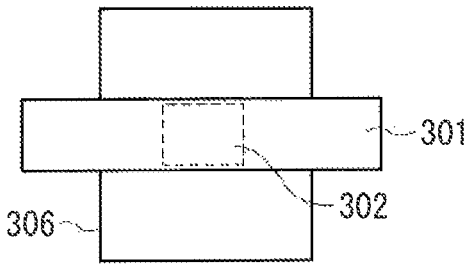
Figure 2B:
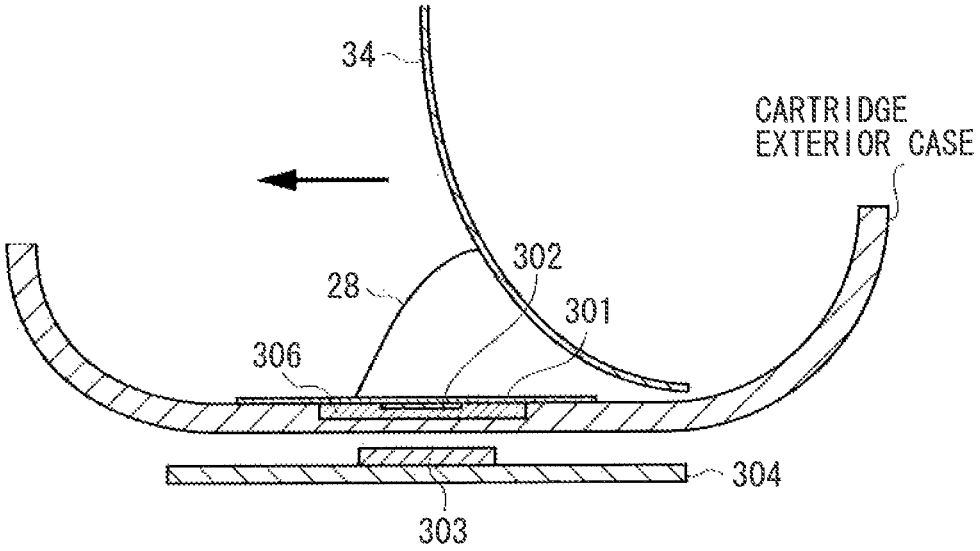

FIGS. 2A and 2B illustrate a developing unit forming a process cartridge according to the present exemplary embodiment. FIG. 2A illustrates the developing unit in a sectional view. The developing unit includes toner 28, a pressure receiving sheet (flexible member) 301 to which pressure is applied, a permanent magnet (member to be detected) 302 for developer amount detection, and a hall sensor (magnetic sensor) 305. The pressure receiving sheet 301 is distorted when pressure is applied by rotation of an agitation sheet 34 via toner. The permanent magnet 302 is attached to the pressure receiving sheet 301, and a spatial position of the permanent magnet 302 changes according to the distortion of the pressure receiving sheet 301. The hall sensor 305 includes a hall element 303 and a hall sensor board 304. The hall element 303 detects a magnetic field change caused by a change in a spatial position of the permanent magnet 302. The hall element 303 is mounted on the hall sensor board 304. A circuit for applying an input voltage to the hall element 303, and a differential amplifier circuit for differentially amplifying an output of the hall element 303 are mounted on the hall sensor board 304.

FIG. 2B is an enlarged view of the pressure receiving sheet 301 illustrated in FIG. 2A. The pressure receiving sheet 301 of the present exemplary embodiment is shaped to cover a portion of a depression 306 of a cartridge exterior case. The permanent magnet 302 is attached in a position on a case depression side of the pressure receiving sheet 301.

In the present exemplary embodiment, the agitation sheet 34 is a polyethylene terephthalate (PET) sheet having a thickness of 150 micrometers (μm), and the pressure receiving sheet 301 is a PET sheet having a thickness of 125 μm. For example, the permanent magnet 302 is a neodymium magnet, and the hall element 303 is a hall element HW-108A manufactured by Asahi Kasei Corporation.

Figure 3A:
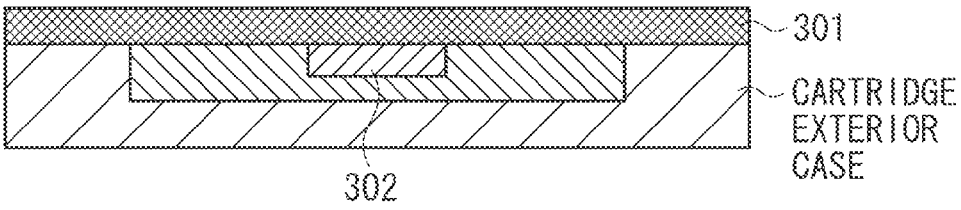
FIGS. 3A and 3B are diagrams illustrating a movement of a pressure receiving sheet according to the first exemplary embodiment.
Figure 3B:
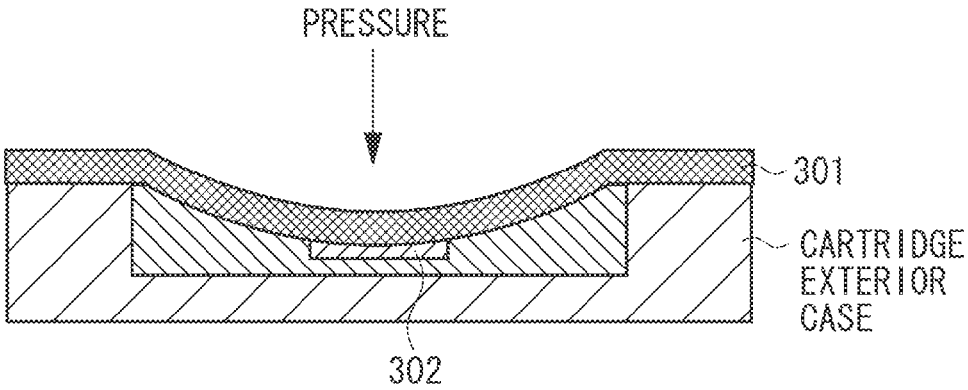

FIGS. 3A and 3B illustrate the pressure receiving sheet 301. FIG. 3A illustrates a situation where pressure is not applied to the pressure receiving sheet 301, whereas FIG. 3B illustrates a situation where pressure is applied to the pressure receiving sheet 301. In FIG. 3A, since the pressure is not applied, the pressure receiving sheet 301 is not distorted. In FIG. 3B, on the other hand, the pressure receiving sheet 301 is distorted downward as downward pressure is applied. Similarly, the distortion of the pressure receiving sheet 301 by pressure changes a spatial position of the permanent magnet 302. Such a change in the spatial position of the permanent magnet 302 causes a change in a magnetic field to be applied to the hall element 303, thereby changing an output of the hall sensor 305. With the output waveform, the timing of distortion of the pressure receiving sheet 301 can be detected, the timing being at which the pressure receiving sheet 301 is distorted by the pressure applied by the agitation sheet 34 being in circular operation.

Figure 4A:
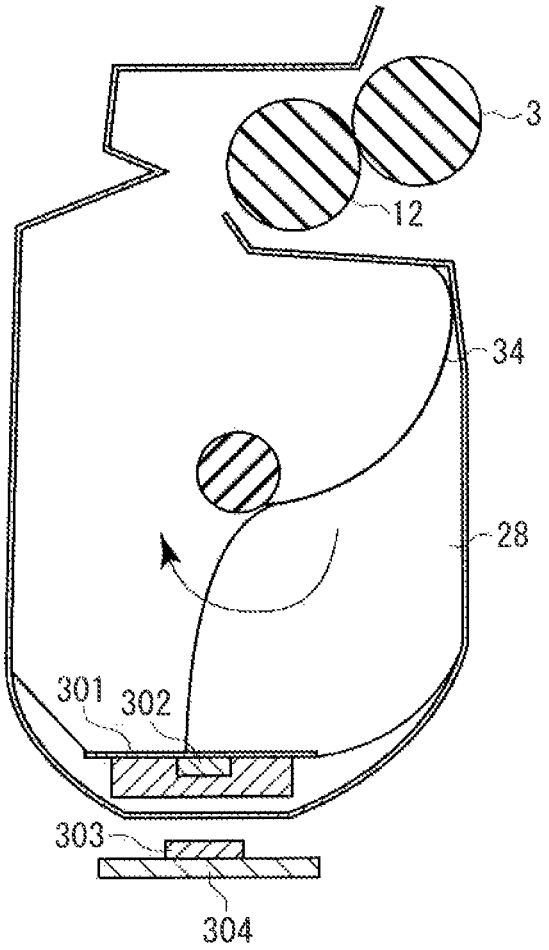
FIGS. 4A and 4B are diagrams illustrating a movement of the developing unit when an amount of toner is large and small, respectively, according to the first exemplary embodiment.
Figure 4B:
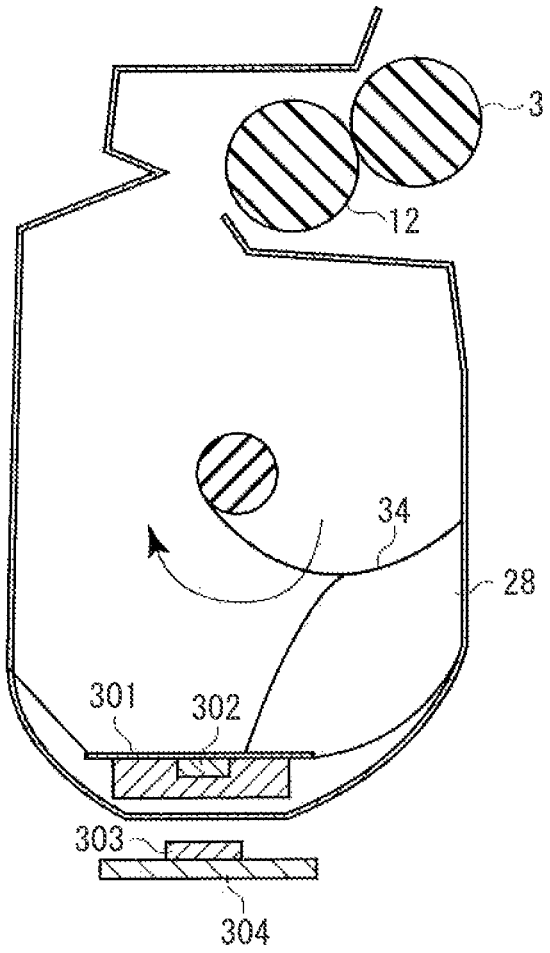

FIGS. 4A and 4B are diagrams illustrating differences in timing at which pressure is applied from the agitation sheet 34 to the pressure receiving sheet 301, the timing being different according to a remaining toner amount. FIG. 4A illustrates operation performed when a remaining toner amount is relatively large, whereas FIG. 4B illustrates operation performed when a remaining toner amount is relatively small. When a remaining toner amount is large as illustrated in FIG. 4A, rotation of the agitation sheet 34 advances timing of pressing the pressure receiving sheet 301 via toner, compared to the case where a remaining toner amount is small. Accordingly, a duration of time between the beginning of distortion of the pressure receiving sheet 301 and the passing of the agitation sheet 34 via the pressure receiving sheet 301 is prolonged. On the other hand, when a remaining toner amount is small as illustrated in FIG. 4B, the timing of pressing the pressure receiving sheet 301 is retarded, so that a duration of time between the beginning of distortion of the pressure receiving sheet 301 and the passing of the agitation sheet 34 via the pressure receiving sheet 301 is shortened. In the present exemplary embodiment, such a principle is used to detect a remaining toner amount.

Figure 5:
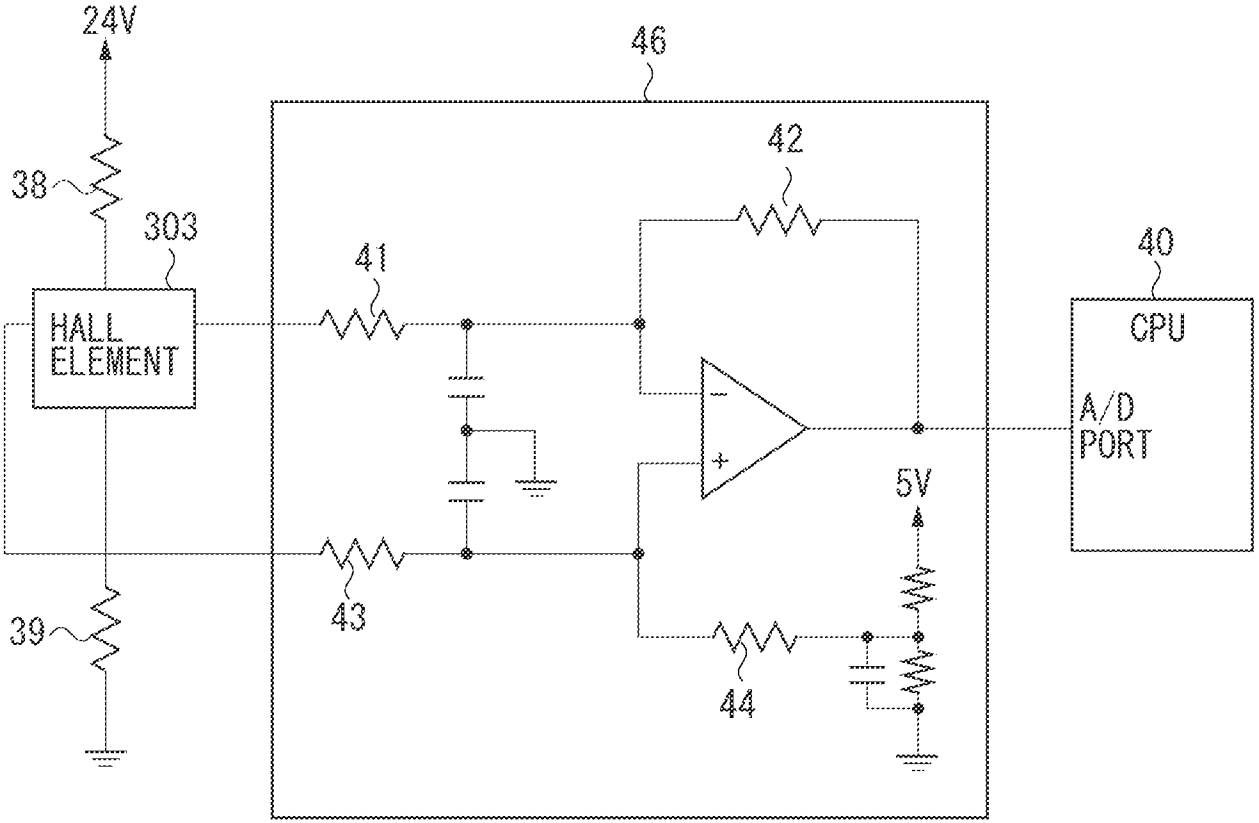
FIG. 5 is a circuit diagram illustrating detection of a magnetic field change caused by displacement of a permanent magnet according to the first exemplary embodiment.

FIG. 5 illustrates a circuit for detecting a magnetic field change caused by a movement of the permanent magnet 302 due to distortion of the pressure receiving sheet 301. In the present exemplary embodiment, fixed resistors 38 and 39 and the hall element 303 are connected in series to a source voltage having a voltage of 24 V (DC), and constant current drive is performed such that a constant current flows into the hall element 303. A differential amplifier circuit 46 includes an operational amplifier. The differential amplifier circuit 46 amplifies a micro-voltage difference output from the hall element 303, and inputs the amplified signal into an analog-digital (A/D) port of the CPU 40. Again may be changed by variations in fixed resistors 41 through 44 disposed inside the differential amplifier circuit 46. Moreover, the CPU 40 sets a threshold for an output of the hall sensor 305 to measure duration of applying pressure by the agitation sheet 34 to the pressure receiving sheet 301, the output having being input thereto.

Figure 6A:
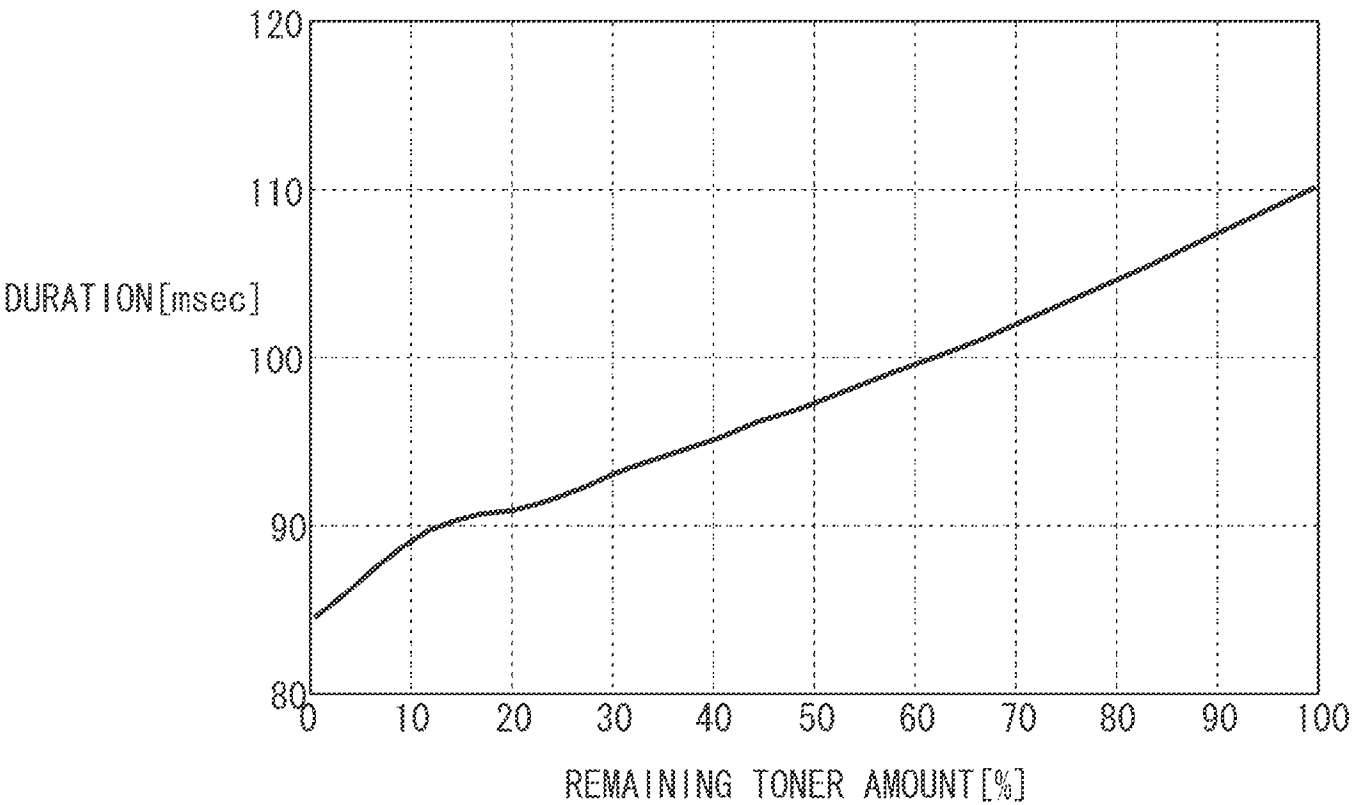
Figure 6B:
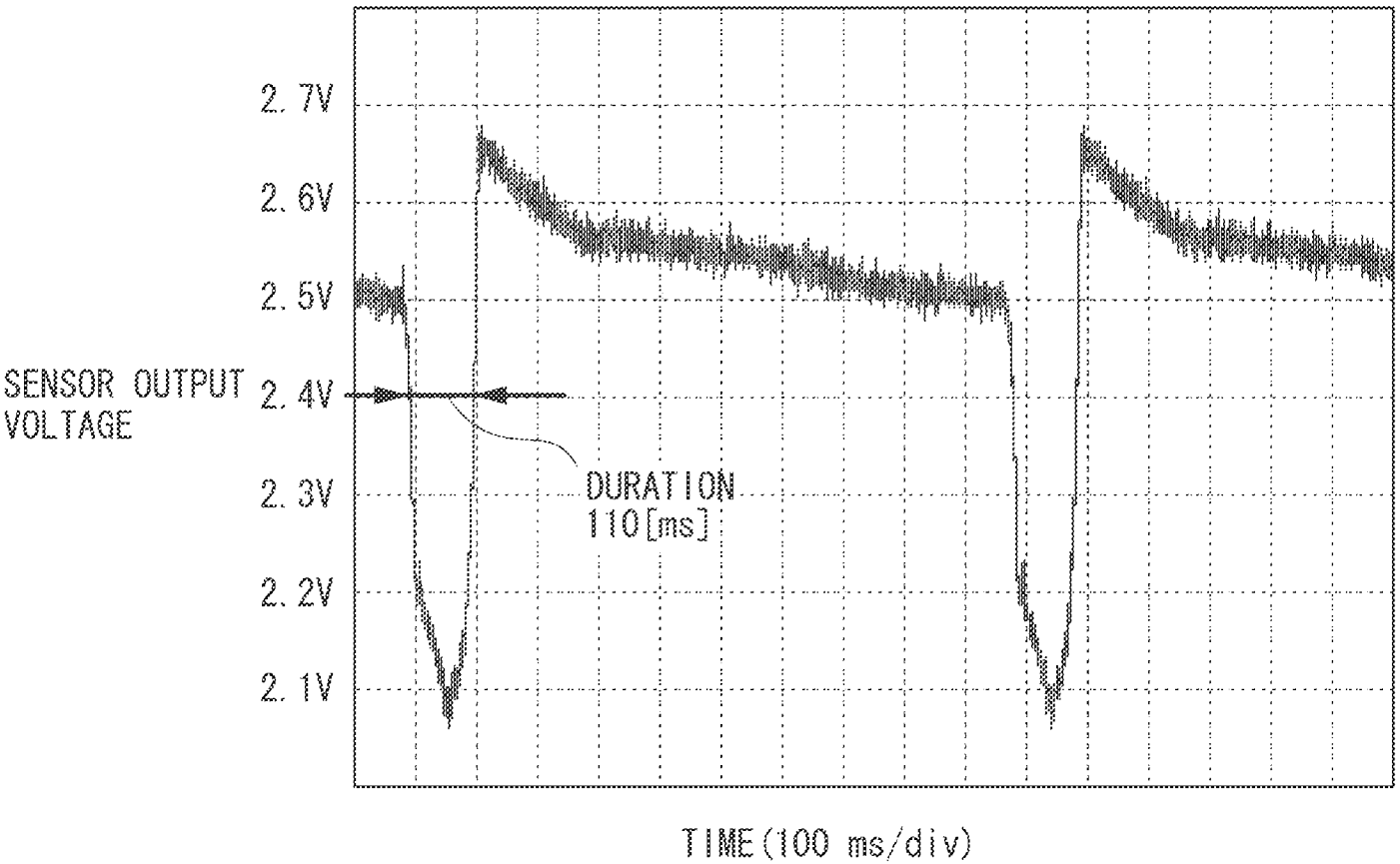

FIGS. 6A, 6B, and 6C illustrate a characteristic of remaining toner amount detection according to the present exemplary embodiment. FIG. 6A is a characteristic graph illustrating a relationship between a remaining toner amount and duration measured by the CPU 40. FIG. 6B illustrates waveform data provided when a remaining toner amount is 100%. If a threshold at the measurement of duration by the CPU 40 is set to 2.4 V, the duration is 110 milliseconds (msec). FIG. 6C is Table T illustrating a relationship between duration and a remaining toner amount when a threshold is set to 2.4 V as similar to FIG. 6B. A remaining toner amount between the numbers in Table T is determined by known linear interpolation. Herein, calculated duration is a value used in the present exemplary embodiment. If any condition changes, durations to be calculated also change. Numerical values in such table used to determine a remaining toner amount similarly change.

Figure 7:
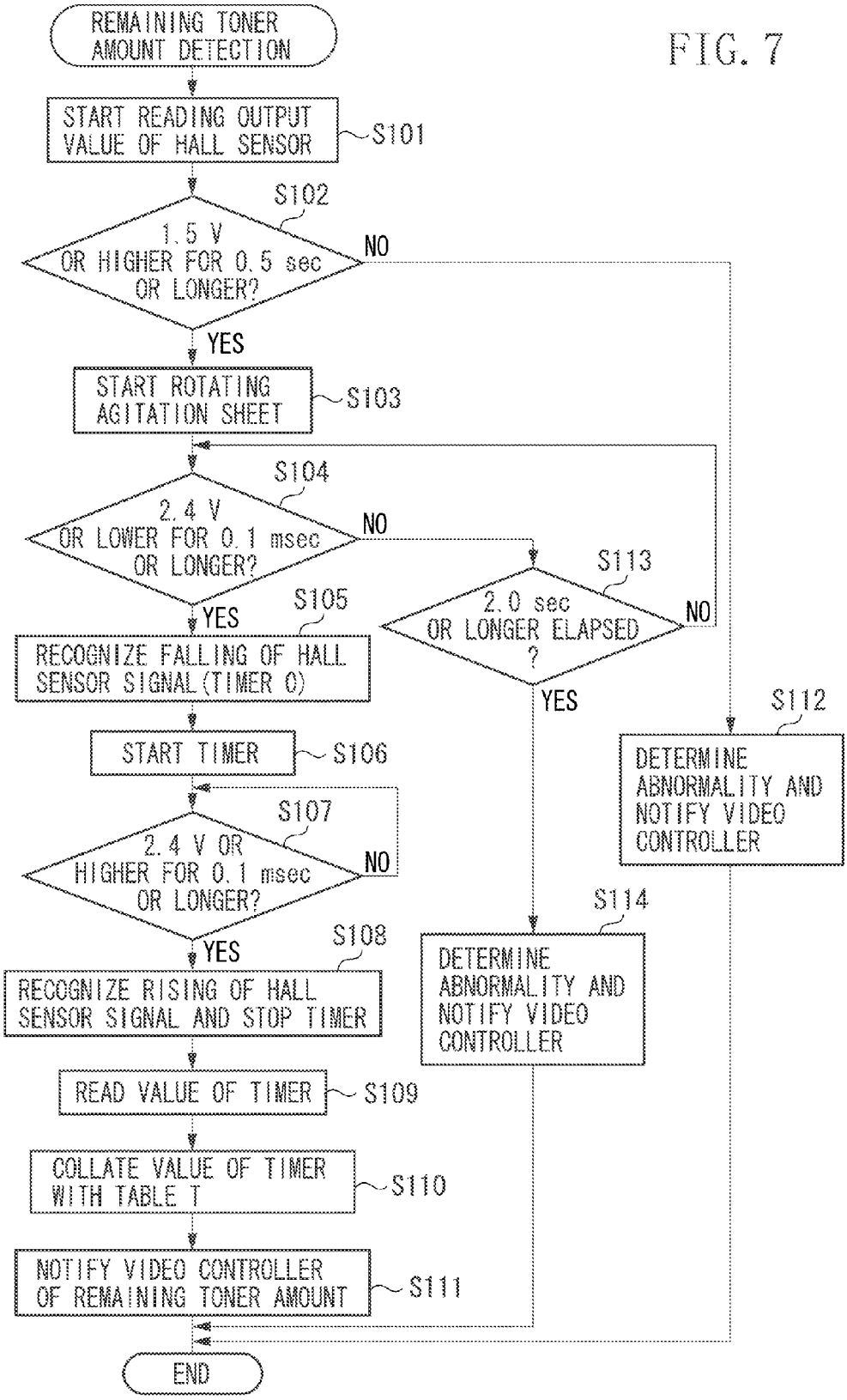
FIG. 7 is a flowchart illustrating operation of remaining toner amount detection according to the first exemplary embodiment.

Now, a procedure for detecting a remaining toner amount according to the present exemplary embodiment is described with reference to the flowchart illustrated in FIG. 7. In the present exemplary embodiment, the CPU 40 executes the procedure illustrated in FIG. 7 as similar to the procedures of flowcharts described in the following exemplary embodiments. However, for example, if an application specific integrated circuit (ASIC) is mounted on an image forming apparatus, the ASIC may have a function to perform any of steps of the procedure.

In step S101, the CPU 40 starts reading an output value of the hall sensor 305 by monitoring an A/D input port thereof. In step S102, the CPU 40 monitors whether the output value remains at 1.5 V or higher for 0.5 sec or longer in a state that the agitation sheet 34 is not in circular operation. If the output value does not remain at 1.5 V or higher for 0.5 sec or longer (NO in step S102), then in step S112, the CPU 40 determines a source voltage abnormality or an abnormality of the hall sensor 305, and notifies the video controller 42. If the output value remains at 1.5 V or higher for 0.5 sec or longer (YES in step S102), then in step S103, the CPU 40 determines that the hall sensor 305 is in normal operation, and starts rotating the agitation sheet 34.

In step S104, the CPU 40 reads an output value of the sensor, and monitors whether the output value remains at 2.4 V or lower for 0.1 msec or longer. In the present exemplary embodiment, the agitation sheet 34 has a cycle of approximately 1 sec. If the output value does not remain at 2.4 V or lower for 0.1 msec or longer even after the lapse of 2.0 sec or longer from the start of reading the output value (YES in step S113), then in step S114, the CPU 40 determines a rotation abnormality of the agitation sheet 34 and notifies the video controller 42. If the sensor output value remains at 2.4 V or lower for 0.1 msec or longer (YES in step S104), then in step S105, the CPU 40 determines falling of a hall sensor signal. In step S106, the CPU 40 starts a timer thereof to measure duration. Subsequently, in step S107, the CPU 40 monitors the A/D input port thereof. If the output value becomes 2.4 V or higher for 0.1 msec or longer (YES in step S107), then in step S108, the CPU 40 determines rising of the hall sensor signal, and stops the timer.

In step S109, the CPU 40 reads a value of the timer. In step S110, the CPU 40 collates the value of the timer with Table T. Subsequently, in step S111, the CPU 40 notifies the video controller 42 of a remaining toner amount corresponding to the collated value.

Accordingly, the duration of applying the pressure by the agitation sheet 34 to the pressure receiving sheet 301 via toner is detected, thereby sequentially detecting a remaining toner amount.

In the present exemplary embodiment, a voltage value is detected at the A/D input port of the CPU 40. However, for example, a voltage detection circuit may be digitized by a comparator, so that duration may be detected at a digital port.

In the present exemplary embodiment, the hall sensor 305 and the CPU 40 are used as a remaining toner amount detection unit included in a main body of the image forming apparatus. However, the permanent magnet 302 may be replaced with an electrode member, and a capacitance sensor may be used instead of the hall sensor 305 to detect duration of a change in distortion of the pressure receiving sheet 301 caused by pressure.

According to the present exemplary embodiment, such configurations and operation described above can provide the following effects. First, since a remaining toner amount is detected by detecting the duration of applying of the pressure by the agitation sheet 34 to the pressure receiving sheet 301, a remaining toner amount, from full to empty states, can be sequentially detected. Secondly, the use of the hall sensor 305 can simplify a detection circuit, and reduce detection time as the hall sensor 305 has a high reaction rate. Moreover, even if the agitation sheet 34 is being rotated at high speed, duration for which the pressure receiving sheet 301 is being distorted is stable as the duration corresponds to a remaining toner amount. Thus, remaining toner amount detection and image forming operation can be performed simultaneously.

In the first exemplary embodiment, a remaining toner amount is detected by detecting duration for which a pressure receiving sheet is receiving pressure when an agitation sheet applies the pressure to the pressure receiving sheet via toner. In a second exemplary embodiment, a pressure sheet is disposed to apply pressure to a pressure receiving sheet when an amount of remaining toner becomes smaller. The pressure sheet has greater flexibility (lower rigidity) than an agitation sheet, and is disposed separately from the agitation sheet. In the second exemplary embodiment, a remaining toner amount is detected by detecting the pressure from the pressure sheet as an output value of a hall sensor that corresponds to a distortion amount of a pressure receiving sheet (a displacement amount of a pressure receiving sheet, a maximum displacement amount in the present exemplary embodiment).

A description is given of a configuration of a color laser printer according to the present exemplary embodiment. Assume that the configurations described with reference to FIGS. 1 and 5 in the first exemplary embodiment are applied to the present exemplary embodiment. Components similar to those of the first exemplary embodiment are given the same reference numerals as above and the description thereof is omitted.

Figure 8A:
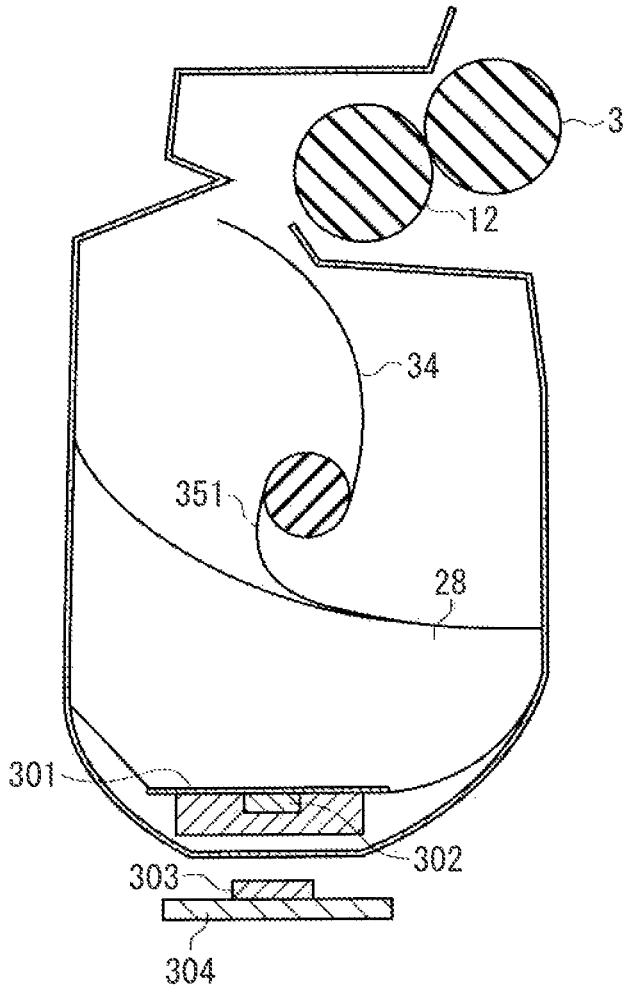
FIGS. 8A, 8B, and 8C are sectional views illustrating a developing unit according to a second exemplary embodiment.
Figure 8B:
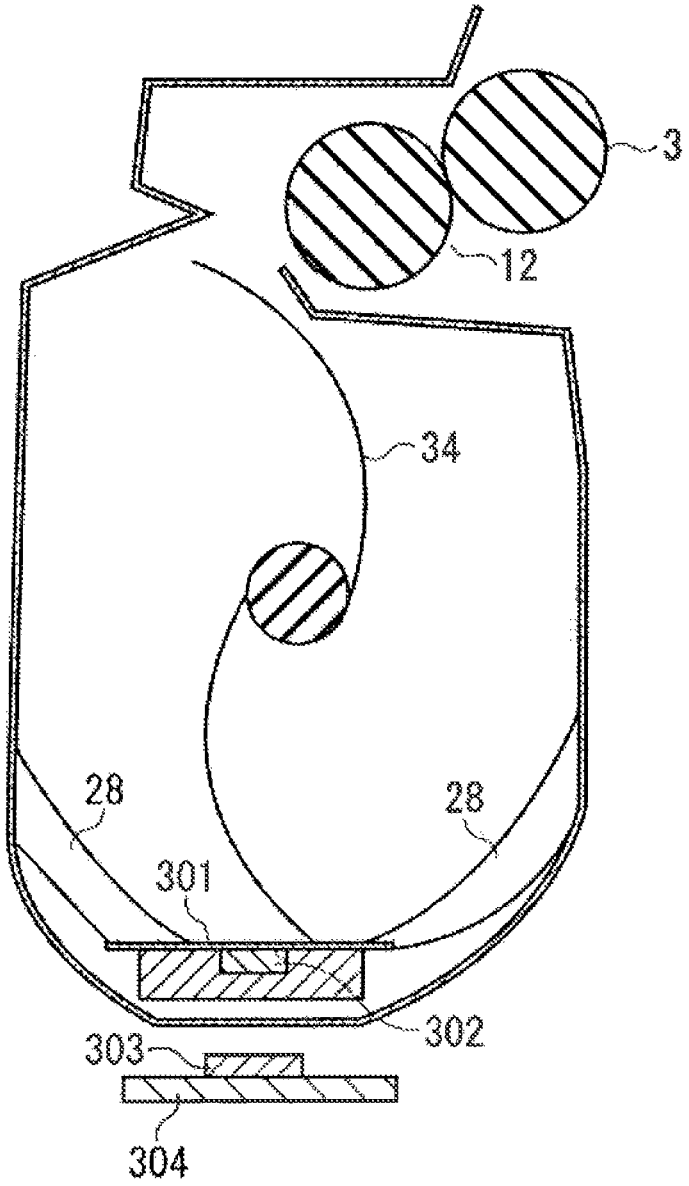

FIGS. 8A and 8B are sectional views illustrating a developing unit forming a process cartridge according to the present exemplary embodiment. The developing unit of the present exemplary embodiment includes a pressure sheet 351 in addition to the configuration of the developing unit illustrated in sectional views in the first exemplary embodiment. The pressure sheet 351 has a half the thickness of an agitation sheet 34 and has great flexibility.

FIGS. 8A and 8B are sectional views illustrating the developing unit when an amount of remaining toner is large and small, respectively. The pressure sheet 351 has great flexibility and is distorted more easily than the agitation sheet 34. When a remaining toner amount is large as illustrated in FIG. 8A, the pressure sheet 351 is circulated inside a toner container coaxially with the agitation sheet 34 without contacting a pressure receiving sheet 301. When a remaining toner amount is small as illustrated in FIG. 8B, on the other hand, the pressure sheet 351 is circulated inside the toner container while contacting the pressure receiving sheet 301 since the pressure sheet 351 has smaller distortion. Accordingly, as a remaining toner amount becomes smaller, the pressure sheet 351 starts to contact the pressure receiving sheet 301, thereby gradually increasing the pressure applied to the pressure receiving sheet 301. Thus, detection accuracy can be enhanced when a remaining toner amount is small.

Figure 8C:
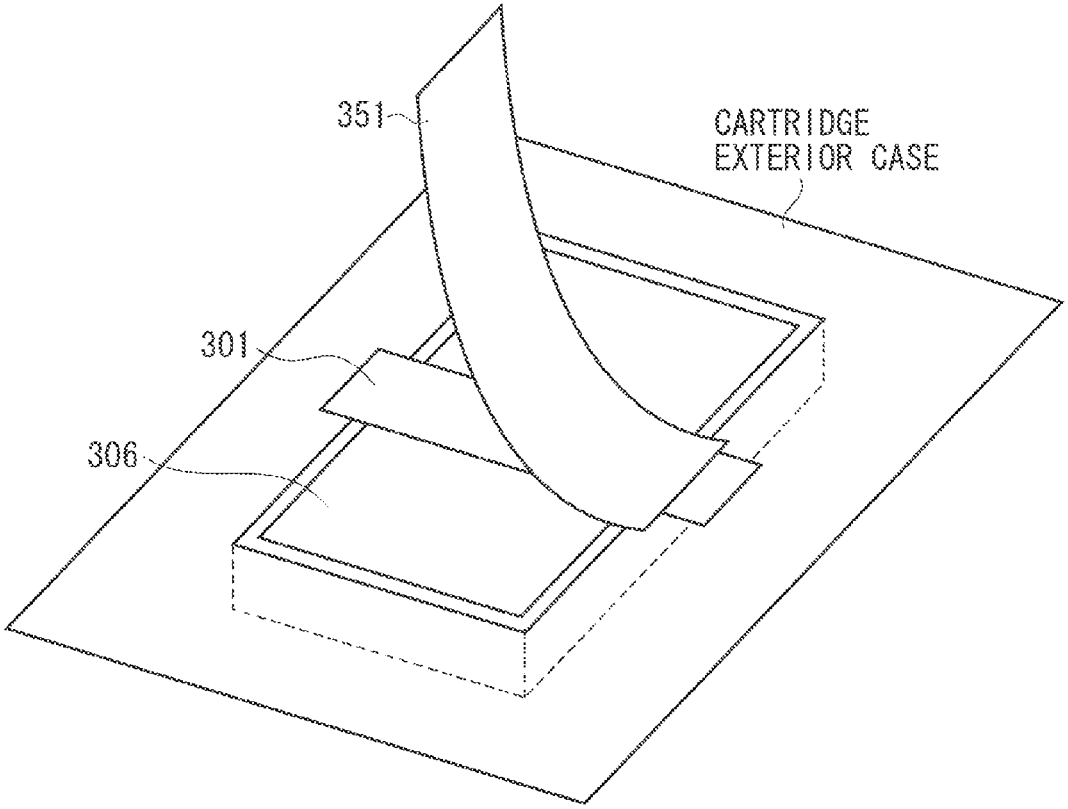

FIG. 8C is a perspective view illustrating the shape of the pressure sheet 351 and the pressure receiving sheet 301. In the present exemplary embodiment, the pressure sheet 351 has a longitudinal width that is substantially the same as that of the pressure receiving sheet 301. However, a longitudinal width of the pressure sheet 351 may be provided in the entire longitudinal direction of the developing unit. On the other hand, since the agitation sheet 34 needs to agitate the entire toner inside the toner container, a longitudinal width thereof is provided in the entire longitudinal direction of the developing unit.

Figure 9:
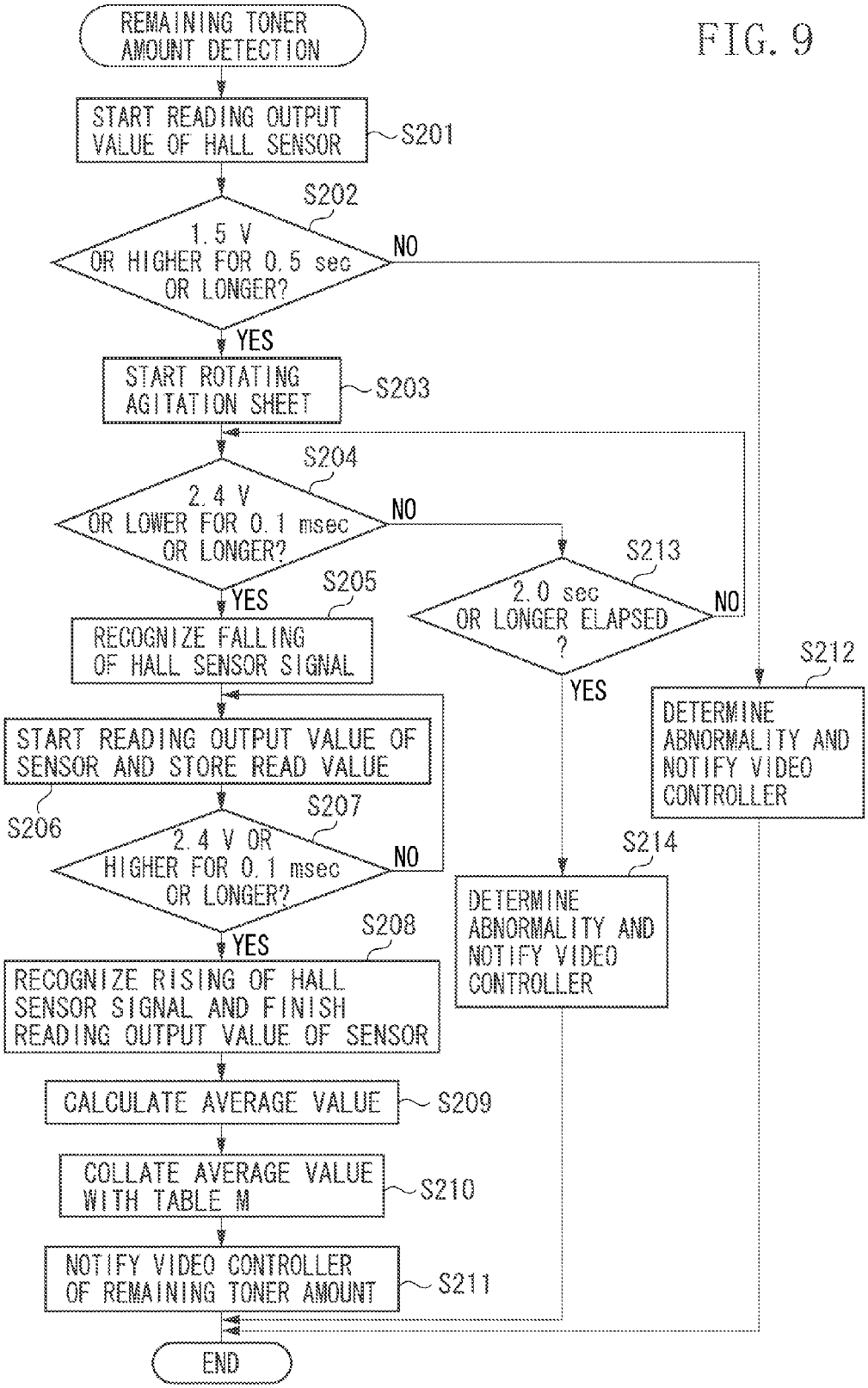
FIG. 9 is a flowchart illustrating operation of remaining toner amount detection according to the second exemplary embodiment.

Next, a procedure for detecting a remaining toner amount according to the present exemplary embodiment is described with reference to the flowchart illustrated in FIG. 9.

In step S201, a CPU 40 starts reading an output value of a hall sensor 305 by monitoring an A/D input port thereof. In step S202, the CPU 40 monitors whether the output value remains at 1.5 V or higher for 0.5 sec or longer in a state that the agitation sheet 34 is not in circular operation. If the output value does not remain at 1.5 V or higher for 0.5 sec or longer (NO in step S202), then in step S212, the CPU 40 determines a source voltage abnormality or an abnormality of the hall sensor 305, and notifies a video controller 42. If the output value remains at 1.5 V or higher for 0.5 sec or longer (YES in step S202), then in step S203, the CPU 40 determines that the hall sensor 305 is in normal operation, and starts rotating the agitation sheet 34.

Subsequently, in step S204, the CPU 40 reads an output value of the sensor, and monitors whether the output value remains at 2.4 V or lower for 0.1 msec or longer. In the present exemplary embodiment, the agitation sheet 34 has a cycle of approximately 1 sec. If the output value does not remain at 2.4 V or lower for 0.1 msec or longer even after the lapse of 2.0 sec or longer from the start of the output value reading (YES in step S213), then in step S214, the CPU 40 determines a rotation abnormality of the agitation sheet 34 and notifies the video controller 42. If the sensor output value remains at 2.4 V or lower for 0.1 msec or longer (YES in step S204), then in step S205, the CPU 40 determines falling of a hall sensor signal. In step S206, the CPU 40 starts reading output values of the sensor, and stores the read values. If the output value becomes 2.4 V or higher for 0.1 msec or longer (YES in step S207), then in step S208, the CPU 40 determines rising of the hall sensor signal, and finishes reading the output value of the sensor.

Subsequently, in step S209, the CPU 40 calculates an average value of the sensor output values successively read, the sensor output values corresponding to distortion amounts of the pressure receiving sheet 301. In step S210, the CPU 40 collates the average value with Table M. In step S211, the CPU 40 notifies the video controller 42 of a remaining toner amount corresponding to the collated value. As similar to the first exemplary embodiment, Table M used in the present exemplary embodiment is calculated based on waveform data acquired by experiments, and a remaining toner amount between the numbers in the table is determined by known linear interpolation. If any condition changes, a value to be calculated for the table also changes.

According to the present exemplary embodiment, such configurations and operation can provide the following effect. According to the first exemplary embodiment, a remaining toner amount is detected by duration with sufficient accuracy. According to the present exemplary embodiment, the pressure applied by a pressure sheet to a pressure receiving sheet is detected based on a hall sensor output value corresponding to a distortion amount of the pressure receiving sheet, so that the accuracy of remaining toner amount detection is further enhanced when a remaining toner amount is small.

In the first exemplary embodiment, an agitation sheet applies pressure to a pressure receiving sheet via toner, and duration for which the pressure receiving sheet is being moved by the pressure is detected. According to a third exemplary embodiment, a reference sheet (pressure member) is used, so that distortion of an agitation sheet is detected with higher accuracy. The reference sheet has higher rigidity than the agitation sheet, and applies pressure to a pressure receiving sheet in conjunction with the agitation operation of the agitation sheet.

First, a description is given of a configuration of a color laser printer according to the present exemplary embodiment. Assume that the configurations described with reference to FIGS. 1 and 5 in the first exemplary embodiment are applied to the present exemplary embodiment. Components similar to those of the first exemplary embodiment are given the same reference numerals as above and the description thereof is omitted.

Figure 10:
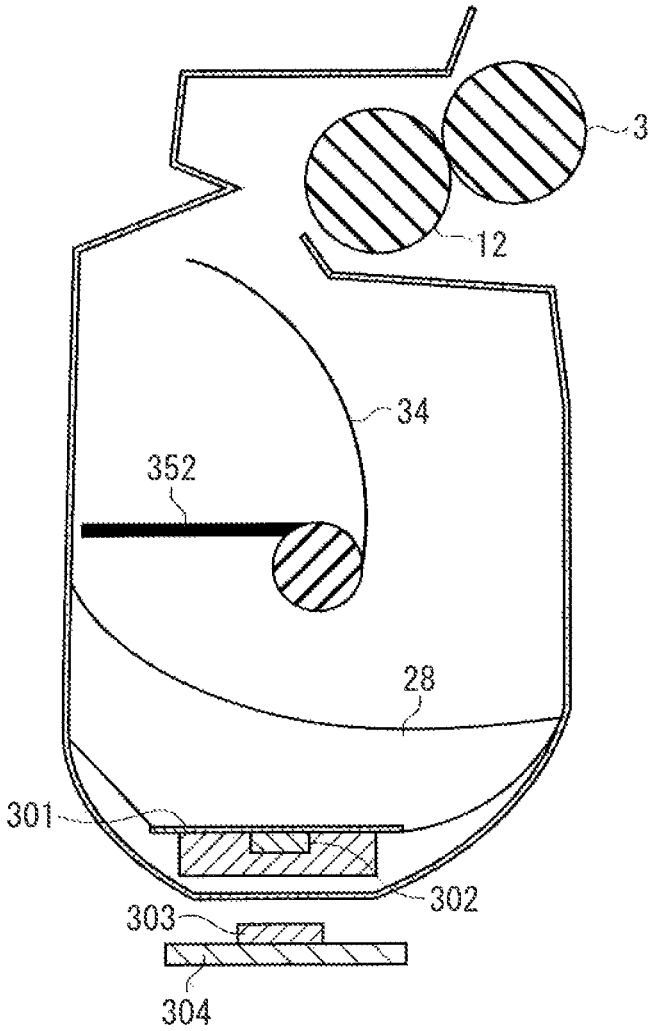
FIG. 10 is a sectional views illustrating a developing unit according to a third exemplary embodiment.

FIG. 10 is a sectional views illustrating a developing unit forming a process cartridge according to the present exemplary embodiment. The developing unit of the present exemplary embodiment includes a reference sheet 352 in addition to the configuration of the developing unit illustrated in sectional views in the first exemplary embodiment. The reference sheet 352 has higher rigidity than an agitation sheet 34. In the present exemplary embodiment, the agitation sheet 34 needs to be provided in the entire longitudinal direction of a developing unit to have an agitation function. However, the reference sheet 352 may be provided in the entire longitudinal direction of the developing unit, or may only have a width that is substantially the same as that of a pressure receiving sheet. In the present exemplary embodiment, the reference sheet 352 is a PET sheet having a thickness of 200 μm.

Figure 11A:
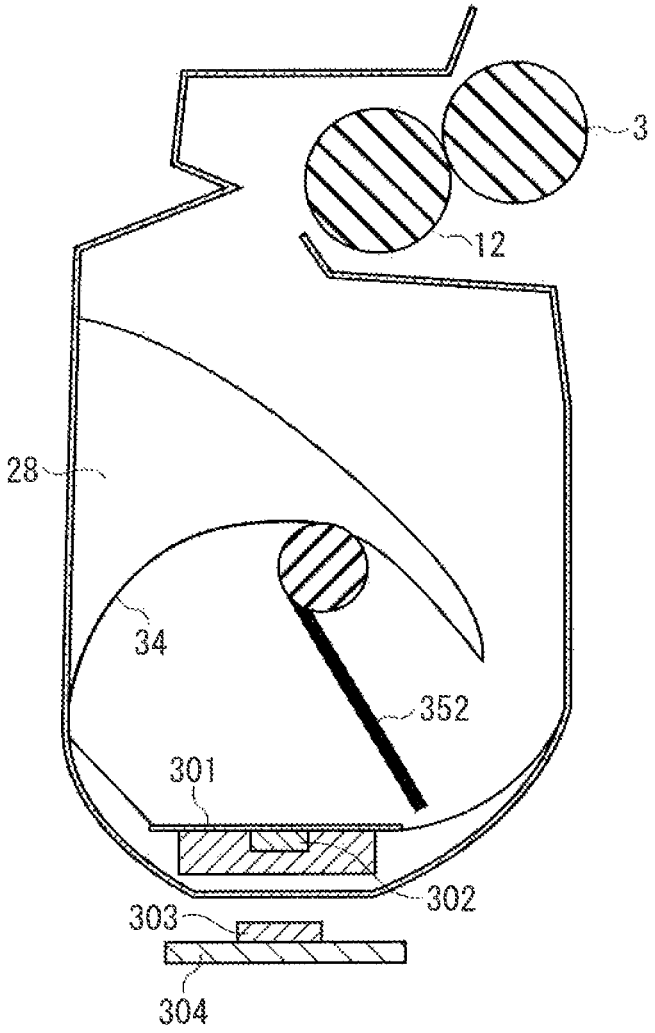
FIGS. 11A, 11B, 11C, and 11D are diagrams illustrating rotation operation inside the developing unit according to the third exemplary embodiment.
Figure 11B:
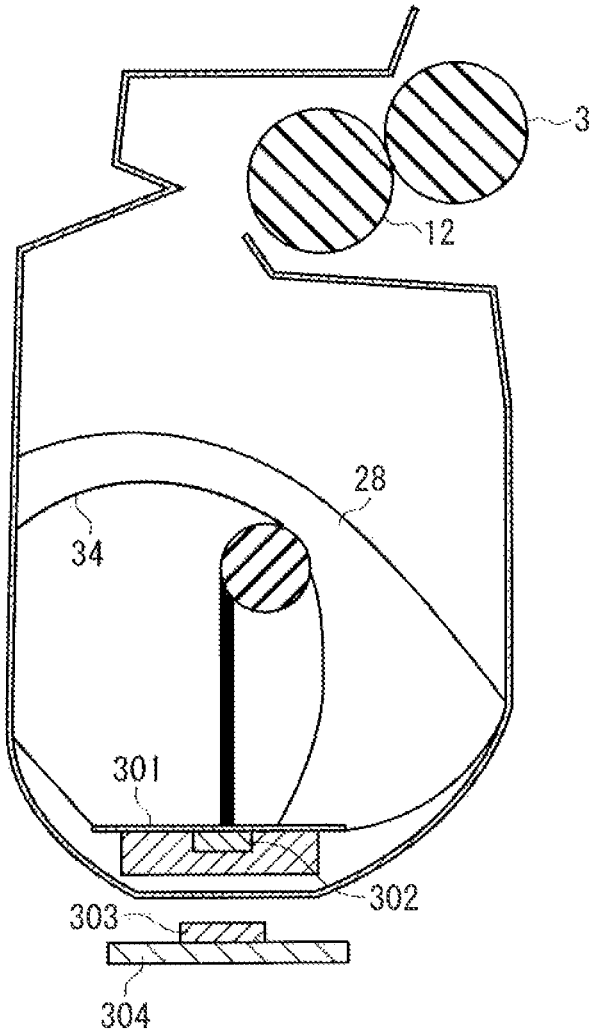
Figure 11C:
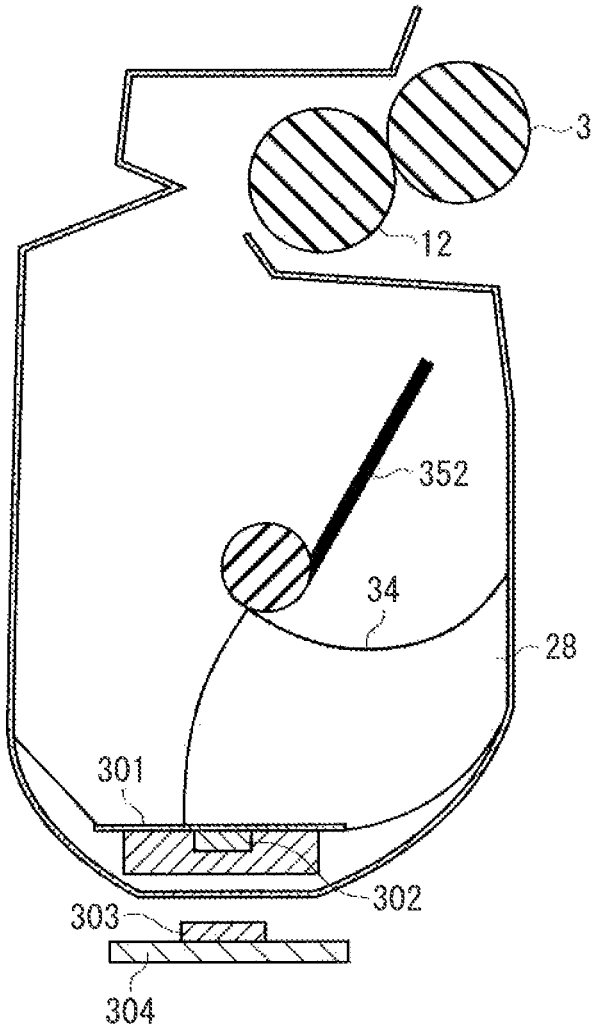
Figure 11D:
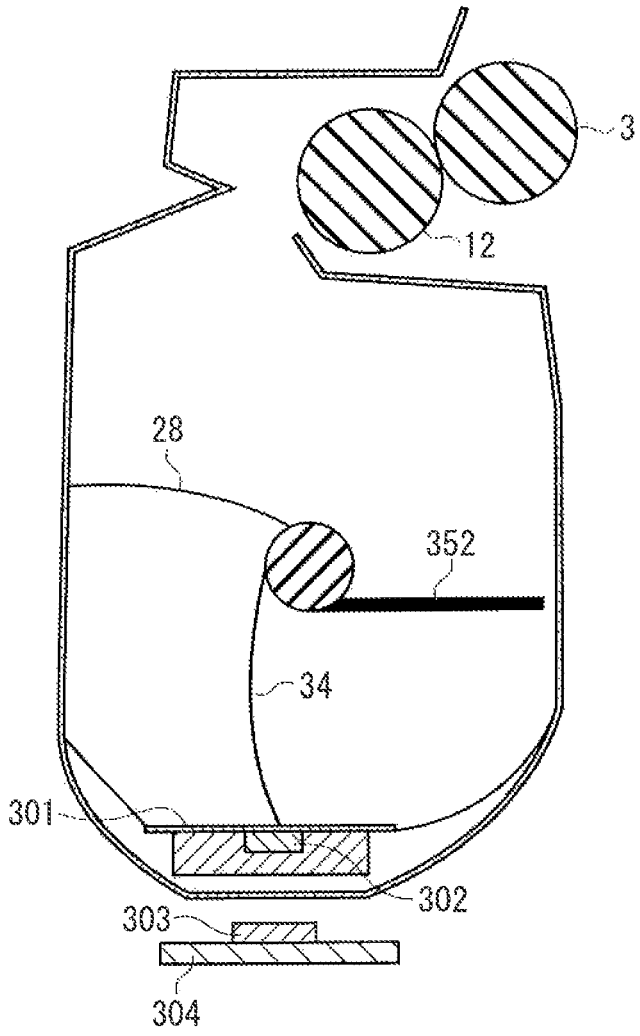

FIGS. 11A, 11B, 11C, and 11D are diagrams illustrating operation for detecting a remaining toner amount inside a toner container according to the present exemplary embodiment. FIG. 11A illustrates a state in which the agitation sheet 34 pushes a toner 28 upward, and pressure is not applied to a pressure receiving sheet 301. FIG. 11B illustrates a state in which the agitation sheet 34 is rotated from a state illustrated FIG. 11A. In FIG. 11B, the reference sheet 352 is moved to an upper portion of the pressure receiving sheet 301, and the pressure is applied to the receiving sheet 301. Since the toner 28 has fluidity, the toner 28 starts to drop by weight thereof from the agitation sheet 34 to the bottom of the toner container before the agitation sheet 34 reaches an uppermost point. The dropped toner 28 is accumulated on the bottom of the toner container. FIG. 11C illustrates a state in which the agitation sheet 34 is further rotated from a state illustrated in FIG. 11B, and starts to push the toner 28 accumulated on the bottom of the toner container. The pressure of the agitation sheet 34 is applied to the pressure receiving sheet 301 via the toner 28, thereby causing the pressure receiving sheet 301 to be distorted as illustrated in FIG. 11C. FIG. 11D illustrates a state in which the agitation sheet 34 is further rotated and passes the upper portion of the pressure receiving sheet 301 while applying pressure to the pressure receiving sheet 301. The distortion of the pressure receiving sheet 301 returns to an original state after the agitation sheet 34 passes the upper portion of the pressure receiving sheet 301.

Accordingly, a distortion amount of an agitation sheet can be detected more accurately by detecting a time difference between the passing of the high rigidity reference sheet 352 via the pressure receiving sheet 301 and the passing of the agitation sheet 34 via the pressure receiving sheet 301.

Figure 12A:
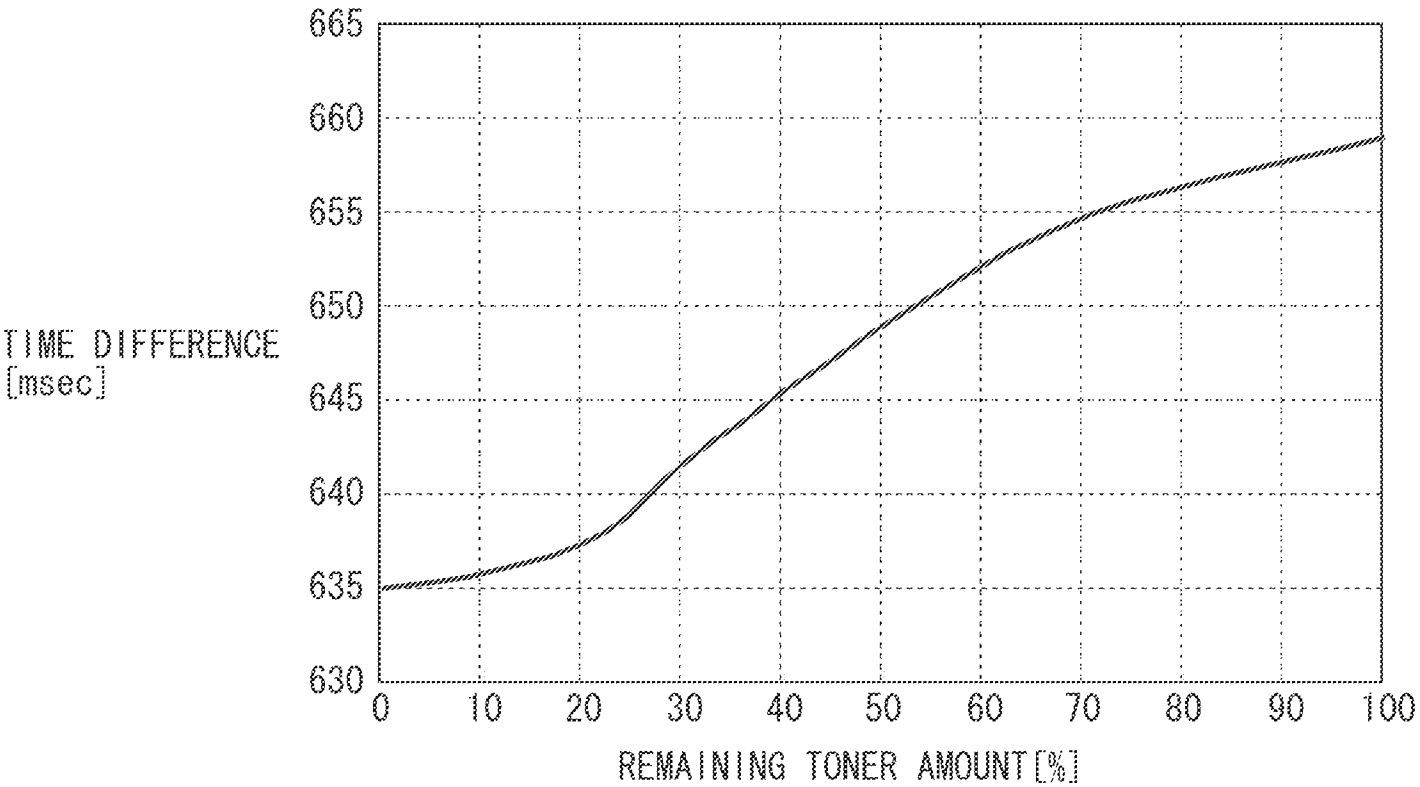
Figure 12B:
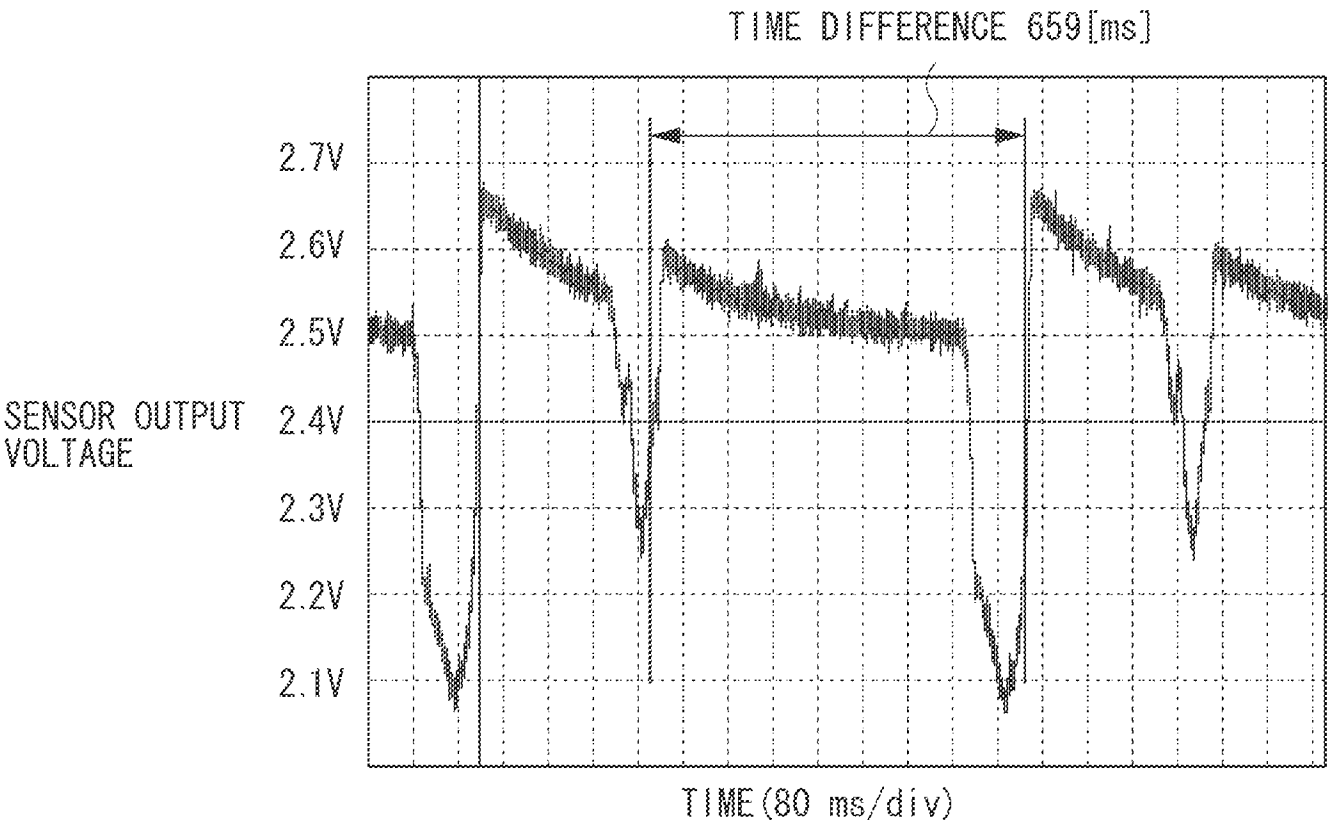

FIGS. 12A, 12B, and 12C illustrate a characteristic of remaining toner amount detection according to the present exemplary embodiment. FIG. 12A is a characteristic graph illustrating a relationship between a remaining toner amount and a time difference measured by the CPU 40. FIG. 12B illustrates waveform data provided when a remaining toner amount is 100%. If a threshold at the measurement of time difference by the CPU 40 is set to 2.5 V, the time difference is 659 msec. FIG. 12C illustrates Table K provided when a threshold is set to 2.5 V as similar to FIG. 12B. A remaining toner amount between the numbers in such table is determined by known linear interpolation. Herein, calculated time difference is a value used in the present exemplary embodiment. If any condition changes, time differences to be calculated also changes. Numerical values in a table used to determine a remaining toner amount similarly change.

Figure 13A:
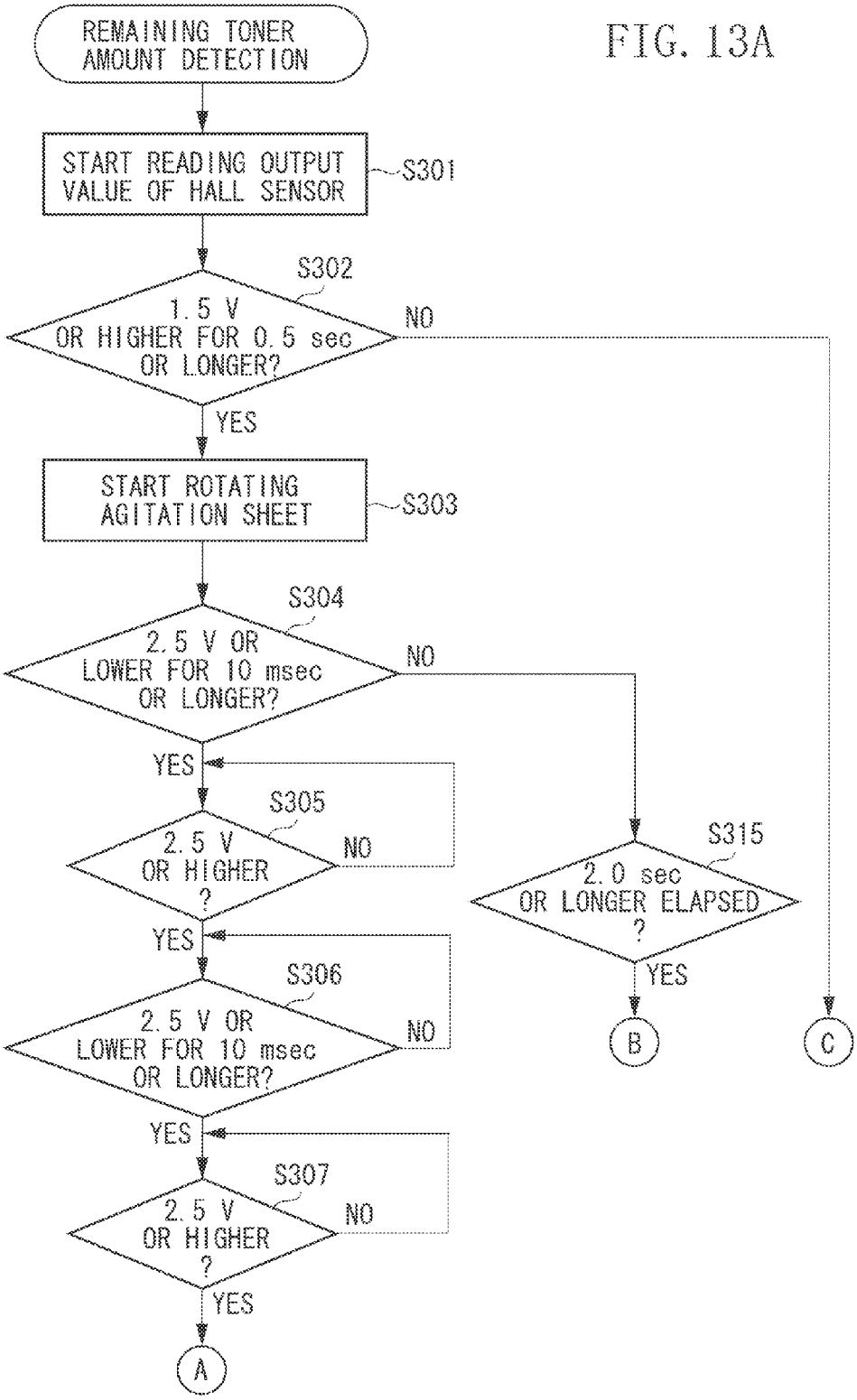
FIGS. 13A and 13B is a flowchart illustrating operation of remaining toner amount detection according to the third exemplary embodiment.
Figure 13B:
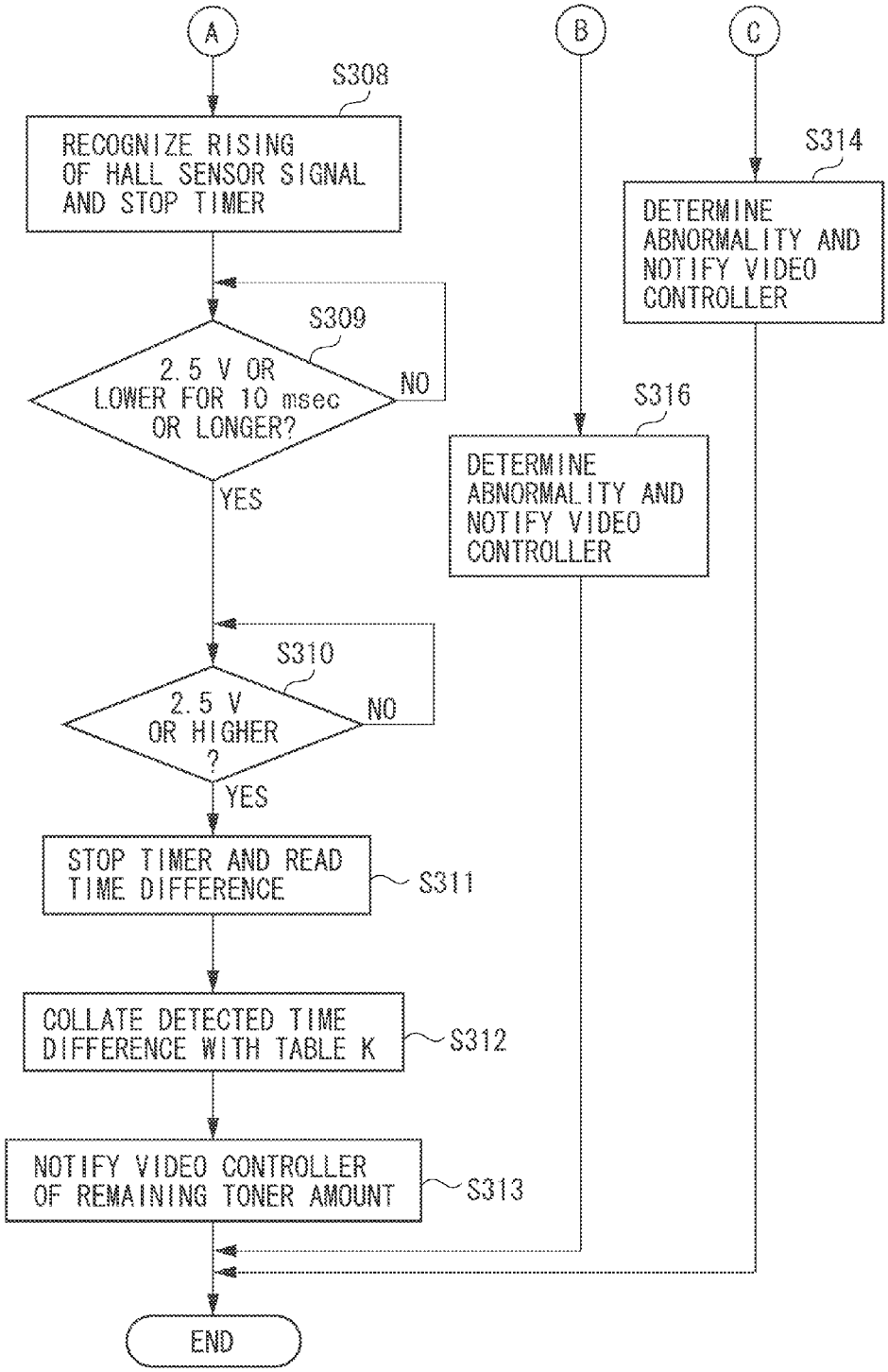

Now, a procedure for detecting a remaining toner amount according to the present exemplary embodiment is described with reference to the flowchart illustrated in FIGS. 13A and 13B. The CPU 40 executes procedures of the flowchart. However, for example, if an ASIC is mounted on an image forming apparatus, the ASIC may have a function to perform any of steps of the procedure.

In step S301, the CPU 40 starts reading an output value of a hall sensor 305 by monitoring an A/D input port thereof. In step S302, the CPU 40 monitors whether the output value remains at 1.5 V or higher for 0.5 sec or longer in a state that the agitation sheet 34 is not in circular operation. If the output value does not remain at 1.5 V or higher for 0.5 sec or longer (NO in step S302), then in step S314, the CPU 40 determines an abnormality of the hall sensor 305, and notifies a video controller 42. If the output value remains at 1.5 V or higher for 0.5 sec or longer (YES in step S302), then in step S303, the CPU 40 determines that the hall sensor 305 is in normal operation, and starts rotating the agitation sheet 34.

Subsequently, in step S304, the CPU 40 reads an output value of the sensor, and monitors whether the output value remains at 2.2 V or lower for 0.01 msec or longer. In the present exemplary embodiment, the agitation sheet 34 has a cycle of approximately 1 sec. If the output value does not remain at 2.2 V or lower for 0.01 msec or longer even after the lapse of 2.0 sec or longer from the start of the output value reading (YES in step S315), then in step S316, the CPU 40 determines a rotation abnormality of the agitation sheet 34 and notifies the video controller 42. If the output value remains at 2.2 V or lower for 0.01 msec or longer (YES in step S304), and then becomes a threshold voltage of 2.5 V or higher (YES in step S305), it is determined that the agitation sheet 34 has passed the pressure receiving sheet 301. If the reference sheet 352 passes the pressure receiving sheet 301, and the sensor output value becomes 2.5 V or lower for 0.01 msec or longer (YES in step S306), the operation proceeds to step S307. If the output value becomes the threshold voltage of 2.5 V or higher (YES in step S307), it is determined that the reference sheet 352 has passed. In step S308, the CPU 40 determines rising of a hall sensor signal, and starts a timer thereof. Subsequently, the agitation sheet 34 begins to apply pressure to the pressure receiving sheet 301. If the sensor output value becomes 2.5 V or lower for 0.01 msec or longer (YES in step S309), and then becomes the threshold voltage of 2.5 V or higher (YES in step S310), it is determined that the agitation sheet 34 has passed the pressure receiving sheet 301. In step S311, the CPU 40 stops the timer, and reads a time difference into a register thereof. In step S312, the CPU 40 collates the detected time difference with Table K. In step S313, the CPU 40 notifies the video controller 42 of a remaining toner amount corresponding to the collated value.

According to the present exemplary embodiment, therefore, a remaining toner amount is sequentially detected by detecting a time difference between the passing of the high rigidity reference sheet 352 on the pressure receiving sheet 301 and the passing of the agitation sheet 34 on the pressure receiving sheet 301.

A fourth exemplary embodiment is described by referring to two differences between the first and fourth exemplary embodiments. The first difference is an arrangement of a pressure receiving sheet. In the first exemplary embodiment, a pressure receiving sheet is disposed inside a toner container. In the fourth exemplary embodiment, on the other hand, a pressure receiving sheet is provided as one portion of an outer wall of a toner container. The second difference is a type of a sensor. Since the pressure receiving sheet is configured to be one portion of the outer wall of the toner container in the fourth exemplary embodiment, a movement of the pressure receiving sheet can be directly observed from outside a developing unit. In the fourth exemplary embodiment, a photo sensor, a light displacement sensor, or a sound sensor can also be used as a sensor for observing the movement of the pressure receiving sheet as well as a hall sensor or a capacitance sensor described in the first exemplary embodiment.

A description is given of a configuration of a color laser printer according to the present exemplary embodiment. Assume that the configurations described with reference to FIG. 1 in the first through third exemplary embodiments are applied to the present exemplary embodiment. Components similar to those of the first exemplary embodiment are given the same reference numerals as above and the description thereof is omitted.

Figure 14A:
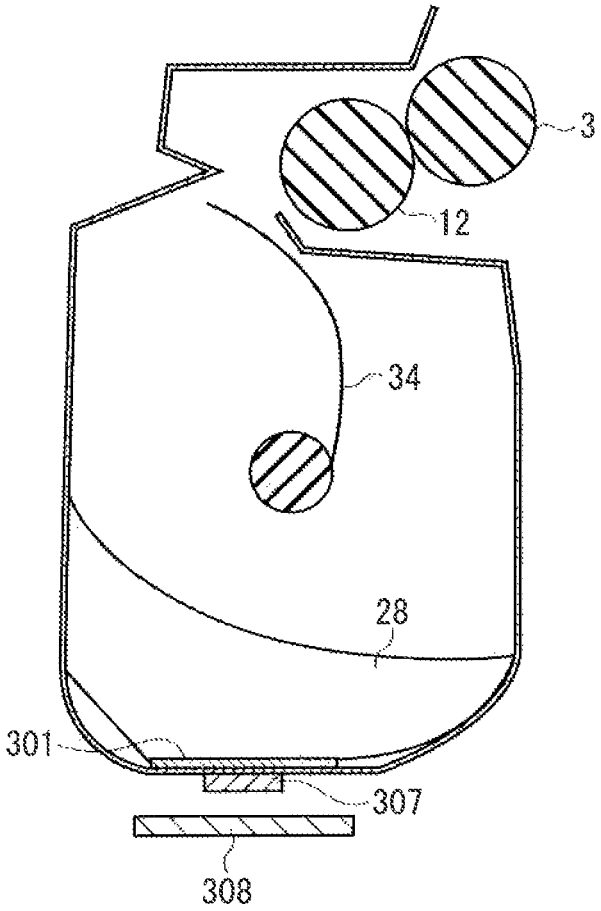
FIGS. 14A and 14B are sectional views illustrating a developing unit according to a fourth exemplary embodiment.
Figure 14B:
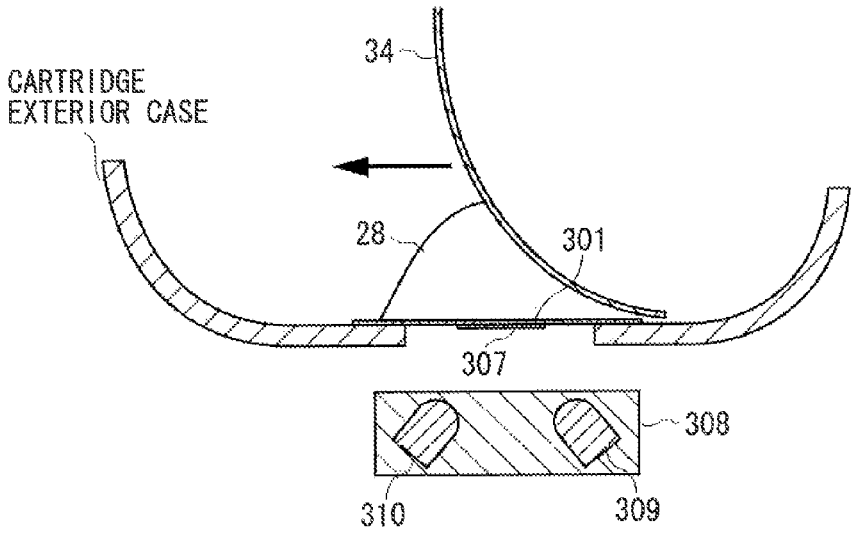

FIGS. 14A and 14B illustrate a developing unit forming a process cartridge according to the present exemplary embodiment. FIG. 14A illustrates the developing unit in a sectional view. In the present exemplary embodiment, a pressure receiving sheet 301 is one portion of an outer wall of a toner container and is exposed to the outside of a cartridge unlike a pressure receiving sheet of the first exemplary embodiment.

FIG. 14B is an enlarged view of the pressure receiving sheet 301 according to the present exemplary embodiment. A reflection plate (reflection member) 307 is attached on a cartridge outer side portion of the pressure receiving sheet 301. A photo sensor 308 emits light toward the reflection plate 307 from a light-emitting diode (LED) 309 mounted on a photo sensor board, and a phototransistor 310 mounted on the photo sensor board thereof receives the light reflected by the reflection plate 307. When the agitation sheet 34 is circulated, the pressure is applied to the pressure receiving sheet 301, thereby causing the pressure receiving sheet 301 to be distorted. Such distortion of the pressure receiving sheet 301 can change a refractive index of the light reflected by the reflection plate 307, thereby causing a change in an output value of the photo sensor 308. As similar to the hall sensor of the first exemplary embodiment, such a principle is used to observe a movement of the pressure receiving sheet 301.

Figure 15:
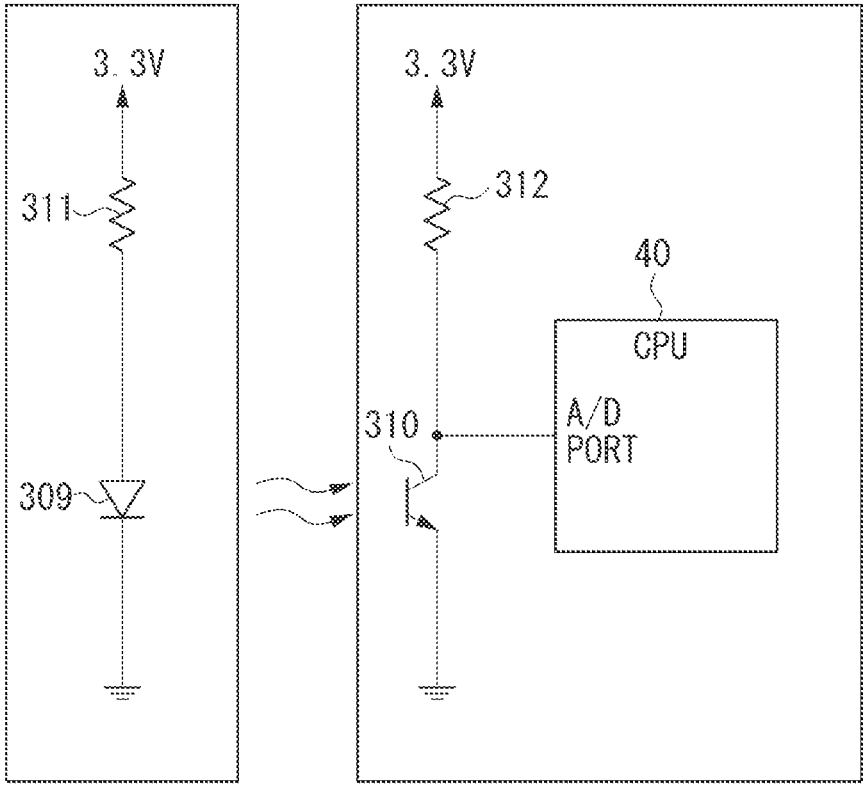
FIG. 15 is a circuit diagram illustrating a photo sensor according to the fourth exemplary embodiment.

FIG. 15 is a circuit diagram illustrating the photo sensor 308. The LED 309 serving as a light emitting element has an anode connected to a source voltage having a voltage of 3.3 V(DC) via a fixed resistor 311 serving as a current limit resistance, whereas a cathode thereof is grounded. A fixed resistor 312 is connected to a collector of the grounded-emitter phototransistor 310. A collector voltage of the phototransistor 310 is input to an A/D port of a CPU 40. When the phototransistor 310 receives light, a collector current serving as alight current flows, so that the collector voltage of the phototransistor 310 decreases.

In the present exemplary embodiment, the reflection plate 307 and the photo sensor 308 are used to detect distortion of the pressure receiving sheet 301. However, the present exemplary embodiment is not limited thereto. The other configuration may be employed as long as distortion of the pressure receiving sheet 301 can be detected from outside the developing unit.

According to such method of the present exemplary embodiment, distortion of the pressure receiving sheet 301 serving as one portion of an outer wall of a toner container can be directly detected from outside by a photo sensor. Thus, a remaining toner amount can be sequentially detected as similar to the first exemplary embodiment.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-175004 filed Aug. 10, 2011, which is hereby incorporated by reference herein in its entirety.

What is claimed is:

1. A developing unit comprising:

a developer storage unit configured to store a developer;

a developer bearing member configured to develop an electrostatic latent image formed on an image bearing member with the developer;

an agitation member configured to agitate the developer in the developer storage unit;

a flexible member, disposed in the developer storage unit, configured to be distorted by pressure applied by the agitation member via the developer; and a magnet member, disposed on the flexible member, configured to be displaced in response to the flexible member being distorted.

2. The developing unit according to claim 1, wherein the agitation member has flexibility.

3. The developing unit according to claim 1, further comprising a pressure member configured to apply pressure to the flexible member in conjunction with an agitation operation of the agitation member, wherein the pressure member has higher rigidity than the agitation member.

4. The developing unit according to claim 1, further comprising a pressure member configured to apply pressure to the flexible member in conjunction with an agitation operation of the agitation member, wherein the pressure member has lower rigidity than the agitation member.

5. A process cartridge detachable from an image forming apparatus main body, the process cartridge comprising:

an image bearing member configured to bear an electrostatic latent image; and a developing unit including:

a developer storage unit configured to store a developer, a developer bearing member configured to develop the electrostatic latent image with the developer, an agitation member configured to agitate the developer in the developer storage unit, a flexible member, disposed in the developer storage unit, configured to be distorted by pressure applied by the agitation member via the developer, and a magnet member, disposed on the flexible member, configured to be displaced in response to the flexible member being distorted.

6. The process cartridge according to claim 5, wherein the agitation member has flexibility.

7. The process cartridge according to claim 5, further comprising a pressure member configured to apply pressure to the flexible member in conjunction with an agitation operation of the agitation member, wherein the pressure member has higher rigidity than the agitation member.

8. The process cartridge according to claim 5, further comprising a pressure member configured to apply pressure to the flexible member in conjunction with an agitation operation of the agitation member, wherein the pressure member has lower rigidity than the agitation member.

9. An image forming apparatus comprising:

a developing unit detachable from the image forming apparatus, the developing unit including:

a developer storage unit configured to store a developer, a developer bearing member configured to develop an electrostatic latent image with the developer, an agitation member configured to agitate the developer in the developer storage unit, a flexible member, disposed in the developer storage unit, configured to be distorted by pressure applied by the agitation member via the developer, and a magnet member, disposed on the flexible member, configured to be displaced in response to the flexible member being distorted;

a magnetic sensor configured to change an output according to displacement of the magnet member; and a control unit configured to control information relating to a remaining developer amount according to the output of the magnetic sensor.

10. The image forming apparatus according to claim 9, wherein the agitation member has flexibility.

11. The image forming apparatus according to claim 9, wherein the developing unit further comprises a pressure member configured to apply pressure to the flexible member in conjunction with an agitation operation of the agitation member, and wherein the pressure member has higher rigidity than the agitation member.

12. The image forming apparatus according to claim 9, wherein the developing unit further comprises a pressure member configured to apply pressure to the flexible member in conjunction with an agitation operation of the agitation member, and wherein the pressure member has lower rigidity than the agitation member.

13. An image forming apparatus comprising:

an image bearing member configured to bear an electrostatic latent image;

a developing unit including:

a developer storage unit configured to store a developer, a developer bearing member configured to develop the electrostatic latent image with the developer, an agitation member configured to agitate the developer in the developer storage unit, a flexible member, disposed in the developer storage unit, configured to be distorted by pressure applied by the agitation member via the developer, and a magnet member, disposed on the flexible member, configured to be displaced in response to the flexible member being distorted;

a magnetic sensor configured to change an output according to displacement of the magnet member; and a control unit configured to control information relating to a remaining developer amount according to the output of the magnetic sensor.

14. The image forming apparatus according to claim 13, wherein the agitation member has flexibility.

15. The image forming apparatus according to claim 13, wherein the developing unit further comprises a pressure member configured to apply pressure to the flexible member in conjunction with an agitation operation of the agitation member, and wherein the pressure member has higher rigidity than the agitation member.

16. The image forming apparatus according to claim 13, wherein the developing unit further comprises a pressure member configured to apply pressure to the flexible member in conjunction with an agitation operation of the agitation member, and wherein the pressure member has lower rigidity than the agitation member.

* * * * *